US005595119A

United States Patent [19]

Hada et al.

[11] Patent Number: 5,595,119

[45] Date of Patent: Jan. 21, 1997

[54] METHOD FOR AUTOMATIC MACHINE-PLATE CHANGE IN ROTARY PRINTING PRESS AND APPARATUS THE SAME

[75] Inventors: Narutoshi Hada; Shingo Nakamura, both of Zama; Takeshi Horiguchi, Ebina, all of Japan

[73] Assignee: Toshiba Kikai Kabushiki Kaisha, Tokyo, Japan

[21] Appl. No.: 540,983

[22] Filed: Oct. 11, 1995

[30] Foreign Application Priority Data

Oct. 12, 1994 [JP] Japan ..... 6-245949

[51] Int. Cl.[6] ..... B41F 27/12

[52] U.S. Cl. ..... 101/477; 101/415.1

[58] Field of Search ..... 101/477, 415.1, 101/378

[56] References Cited

U.S. PATENT DOCUMENTS

| | | | |
|---|---|---|---|
| 5,074,212 | 12/1991 | Kobler et al. | 101/477 |
| 5,127,328 | 7/1992 | Wieland | 101/477 |
| 5,289,775 | 3/1994 | Spiegel et al. | 101/477 |
| 5,293,820 | 3/1994 | Maejima et al. | 101/477 |
| 5,406,888 | 4/1995 | Sugiyama et al. | 101/477 |
| 5,440,988 | 8/1995 | Ito | 101/477 |
| 5,443,006 | 8/1995 | Beisel et al. | 101/477 |
| 5,454,317 | 10/1995 | Kobler et al. | 101/477 |
| 5,483,892 | 1/1996 | Stiel | 101/477 |
| 5,487,336 | 1/1996 | Simeth | 101/477 |
| 5,495,805 | 3/1996 | Beisel et al. | 101/477 |

OTHER PUBLICATIONS

English language Abstract of Japanese Patent Application Laid–Open No. Hei 5–246013 (1 page).

*Primary Examiner*—Eugene H. Eickholt

*Attorney, Agent, or Firm*—Flynn, Thiel, Boutell & Tanis, P.C.

[57] ABSTRACT

An automatic machine-plate change system 20 of the web-offset printing press 10 has new-plate cassettes 30U, 30L provided in a priming press 11 having plate cylinders 13U, 13L to accommodate new-plates 80U, 80L newly wound around the plate cylinders 13U, 13L, and has movement systems 40U, 40L moving the new-plate cassettes 30U, 30L to cause edges 32U, 32L of the new-plate cassettes 30U, 30L to move toward and away from the plate cylinders. Therefore, it is possible to actualize an automatic machine-plate change with a simple structure and a simple operation, to quickly and efficiently change the machine-plates, to reduce the cost of facilities and to actualize the automatic machine-plate change in high certainty and reliability. As for a more concrete structure of the movement systems 40U, 40L, for example, it is possible to provide pendulum systems 41U, 41L causing the new-plate cassettes 30U, 30L to pivot at the fulcrum around the other edges 33U, 33L opposite to the edges 32U, 32L to move the edges 32U, 32L toward and away from the plate cylinders 13U, 13L, and shifting mechanisms 42U, 42L causing the new-plate cassettes 30U, 30L to shift along the axis in the direction of the axis of the plate cylinders 13 U, 13 L.

16 Claims, 16 Drawing Sheets

METHOD FOR AUTOMATIC MACHINE-PLATE CHANGE IN ROTARY PRINTING PRESS AND APPARATUS THE SAME

BACKGROUND OF THE INVENTION

1. Field of the Invention

This invention relates to a method for an automatic machine-plate change in a rotary printing press and an apparatus for the same and, more particularly, to automatization of a work, including delivery of a machine-plate, which the machine-plate wound around a plate cylinder of the rotary printing press is changed for a new machine-plate.

2. Description of the Related Art

Generally, in a rotary printing press, priming is facilitated to ink in a sheet-shaped machine-plate wound around a circumferential surface, and then transferred onto paper or the like with ink on the machine-plate which is rotated.

Conventionally, various automatization has attempted changing the machine-plates of a used-plate and a new-plate.

The typical instance is an automatic machine-plate change method which uses a robot and a vacuum device. In this method, the machine-plate change is performed to deliver the machine-plate onto the plate cylinder or from the plate cylinder by moving the machine-plate by means of the robot while a vacuum pat of the vacuum device is sucking the machine-plate.

The work of changing the machine-plates includes the aforementioned delivering work of the machine-plates (the work of delivering a new-plate onto the plate cylinder and the work of delivering a used-plate from the plate cylinder), and moreover, the work of winding the new-plate onto the plate cylinder and removing the used-plate wound around the plate cylinder thus far. Ordinarily, for winding of the machine-plate onto the circumferential surface of the plate cylinder, a plate catch system, involvedly engaging the end of the machine-plate into a catch shaft rotatably placed in the plate cylinder, is used. The catch shaft of the plate catch system has a slit, extending in the axis direction, to catch the end of the machine-plate at the slit.

In regards to the automatization of the work of winding and removing the machine-plate, there is a plate change system disclosed by the present applicant (Japanese Patent Application Laid-open No. Hei. 5-246013). The plate change system includes a catch shaft driving means causing the catch shaft to rotate with an air cylinder device or the like, a weight roller pressing the machine-plate onto the plate cylinder by being rotatably moved to attach the circumferential surface of the plate cylinder, and a roller driving means performing the attachment and release of the roller by rotatably moving the roller with the air cylinder device or the like, thereby the automatization of the work of winding and removing the machine-plate is facilitated.

In the method for the automatic machine-plate change, in which it uses the aforementioned robot and vacuum device, there is a disadvantage caused by decreasing certainty and reliability because of the possibility of insufficient suction of the vacuum pat. That is, surroundings of each priming portion of the rotary printing press is in an undesirable state caused by, for example, ink-mist and paper-dust, which causes a sucking mouth of the vacuum pat to easily close, so that it is possible that the machine-plate slips off or is out of place because of the insufficient suction during delivery. It is possible that, the winding of the plate cylinder is difficult to be performed smoothly if the machine-plate slips off, if the machine-plate is out of place and falls and the machine-plate is damaged, whereby improvement of certainty and reliability has been expected.

Furthermore, there is a disadvantage in the cost for facilities which become very high when the expensive robot is provided in each upper and lower plate cylinder.

In order to reduce cost for facilities, there is a device used for delivering the machine-plates to both the upper and lower plate cylinders by using one robot to move both plates. But, in the above device, a wide space is required to move the robot, a high costing movement system of the robot is required, and work efficiency is decreased by taking much time to change the machine-plates because of the time involved in moving the robot, producing disadvantages.

Therefore, the automatization of the work of winding and removing the machine-plate in accordance with the present applicant, and further, the work of delivering the machine-plate is intended to be a much more efficient automatization.

It is an object of the present invention to provide the method for the automatic machine-plate change in the rotary printing press and the apparatus for the same, which increase certainty and reliability, in which the machine-plate change can be actualized by simple structure and operation and can be quickly and efficiently performed, and in which the cost for facilities can be reduced.

SUMMARY OF THE INVENTION

To attain this object, the present invention is intended to provide a movable new-plate cassette accommodating a new-plate.

A method for an automatic machine-plate change in a rotation printing press according to the present invention is featured by accommodating a new-plate newly wound around a plate cylinder into a new-plate cassette provided in a printing press having the plate cylinder, delivering the new-plate to a position next to the plate cylinder by moving the new-plate cassette to cause the edge of the new-plate cassette to approach the plate cylinder, and then moving the new-plate cassette to cause the edge of the new-plate cassette to go away from the plate cylinder.

When a new-plate head of the new-plate is engaged into a catch groove provided on the circumferential surface of the plate cylinder, it is advisable that a detachabe weight roller, provided to rotatable touch to the circumferential surface of the plate cylinder, is moved toward the plate cylinder and the plate cylinder is rotated at low speed.

Furthermore, the automatic machine-plate change system in the rotation printing press, according to the present inveniton, is featured by the new-plate cassette provided in the printing press having the plate cylinder to accommodate the new-plate to be newly wound around the plate cylinder, and a movement system moving the new-plate cassette to cause the edge of the new-plate cassette to move toward and away from the plate cylinder.

The movement system may be voluntarily structured, if the system is adapted to be capable of moving the new-plate cassette, to cause the end of the new-plate cassette to move toward and away from the plate cylinder, however, when considering about the simplifications of a mechanical sturcture and operation, and a reduction in the space for facilities, it is advisable that the movement system has a pendulum system causing the edge to move toward and away from the plate cylinder by pivoting the new-plate cassette at the fulcrum around the other edge opposite to the edge, and has a shifting mechanism causing the new-plate cassette to shift along the axial direction of the plate cylinder.

A posture of the new-plate cassette when the new-plate is sent from the new-plate cassette to the plate cylinder is voluntarily positioned if the end of the new-plate cassette is adjacent to the plate cylinder, however, in a case of, for example, a delivering direction of the new-plate to the plate cylinder is almost downward ( e.g., in the upper plate cylinder of the printing press printing on the both sides of web), it is advisable that the new-plate cassette has a new-plate foot gripper supporting the new-plate by abutting to the new-plate foot of the new-plate, and has a tensional reel pulling the new-plate foot gripper in the opposite direction of the plate cylinder.

It is advisable that the edge (the edge of the side of the plate cylinder) of the new-plate cassette has, thereon, a plate head peeler, peeling a used-plate head of a used-plate wound around the plate cylinder from the plate cylinder, and the end of the plate head peeler is capable of moving toward and away from the plate cylinder.

It is advisable that close to the new-plate cassette is a belt conveyor which moves with the new-plate cassette by the movement system, a detachable clamp conveyance roller pressing the used-plate on the belt conveyor, a foot pass detecting sensor detecting the passing of the used-plate foot of the used-plate through a downstream delivering direction from a providing position of the clamp conveyance roller, and a head pass detecting sensor detecting the passing of a used-plate head of the used-plate through an upstream delivering direction from the providing position of the clamp conveyance roller.

In the present invention as described thus far, the automatic machine-plate change is facilitated by accommodating the new-plate to be newly wound around the plate cylinder into the new-plate cassette, delivering the new-plate to a position next to the plate cylinder by moving the new-plate cassette by means of the movement system to cause the edge of the new-plate cassette to approach the plate cylinder, moving the empty new-plate cassette, by means of the movement system, to cause the edge of the new-plate cassette to go away from the plate cylinder.

Therefore, the new-plate can be certainly delivered onto the plate cylinders even in a negative environment caused by, for example, ink-mist and paper-dust, and further, there is no anxiety regarding the machine-plate being damaged by fall, with the result that certainty and reliability for the automatic machine-plate change can be sufficiently progressed as compared with the conventional automatic machine-plate change using a robot and a vacuum device.

Comparing with the use of the robot, there is no complex operation and the automatic machine-plate change is actualized with a simple mechanical structure and easy operation, whereby the machine-plates are changed quickly, efficiently, and the cost for facilities are reduced.

By accompanying with automatization the work of removing the used-plate and the work of winding the new-plate, which is known from the aforementioned Japanese Patent Application Laid-open No. Hei 5-246013 by the present applicant, more efficient automatization for all processes of the automatic machine-plate change can be facilitated.

Furthermore, when the new-plate head of the new-plate is engaged into a catch groove provided on the circumferential surface of the plate cylinder, if a detachable weight roller, provided to rotatable touch to the circumferential surface of the plate cylinder, is moved toward the plate cylinder and the plate cylinder is rotated at low speed, whereby the plate head of the new-plate is certainly inserted into the catch groove and the winding of the new-plate is certainly performed.

When the movement system has a structure to be composed of the pendulum system and the shifting mechanism, simplification of the mechanical structure and operation and reduction of the space for facilities are definitely and easily achieved. When the new-plate foot gripper supporting the new-plate and the tensional reel pulling the new-plate foot gripper are placed in the new-plate cassette, prevention of the slacking of the new-plate causes the delivery of the new-plate from the new-plate cassette to the plate cylinder to smoothly take place. It is very effective, especially when the delivering direction of the new-plate to the plate cylinder is downwards.

If on the end (the end side of the plate cylinder) of the new-plate cassette, the plate head peeler capable of moving toward and away from the plate cylinder to peel the used-plate is provided, the used-plate head of the used-plate can be hooked and easily peeled from the plate cylinder by projecting the end of the plate head peeler to the plate cylinder, whereby the delivery of the used-plate is smoothly performed and the used-plate can be delivered from the plate cylinder during the continuous rotation of the plate cylinder, without interrupting the rotation..

Furthermore, if close to the new-plate cassette is, a belt conveyor for delivering the used-plate, the clump conveyance roller, the foot pass detecting sensor and the head pass detecting sensor, the used-plate can be pressed onto the belt conveyor by the clump conveyance roller to avoid any bent portions, such as the used-plate head and the usedplate foot, then the delivery of the used-plate becomes much smoother.

DETAILED DESCRIPTION OF THE PREFERRED EMBODIMENT(S)

A preferable embodiment according to the present invention will be explained with referring to attached drawings.

Figure 1:
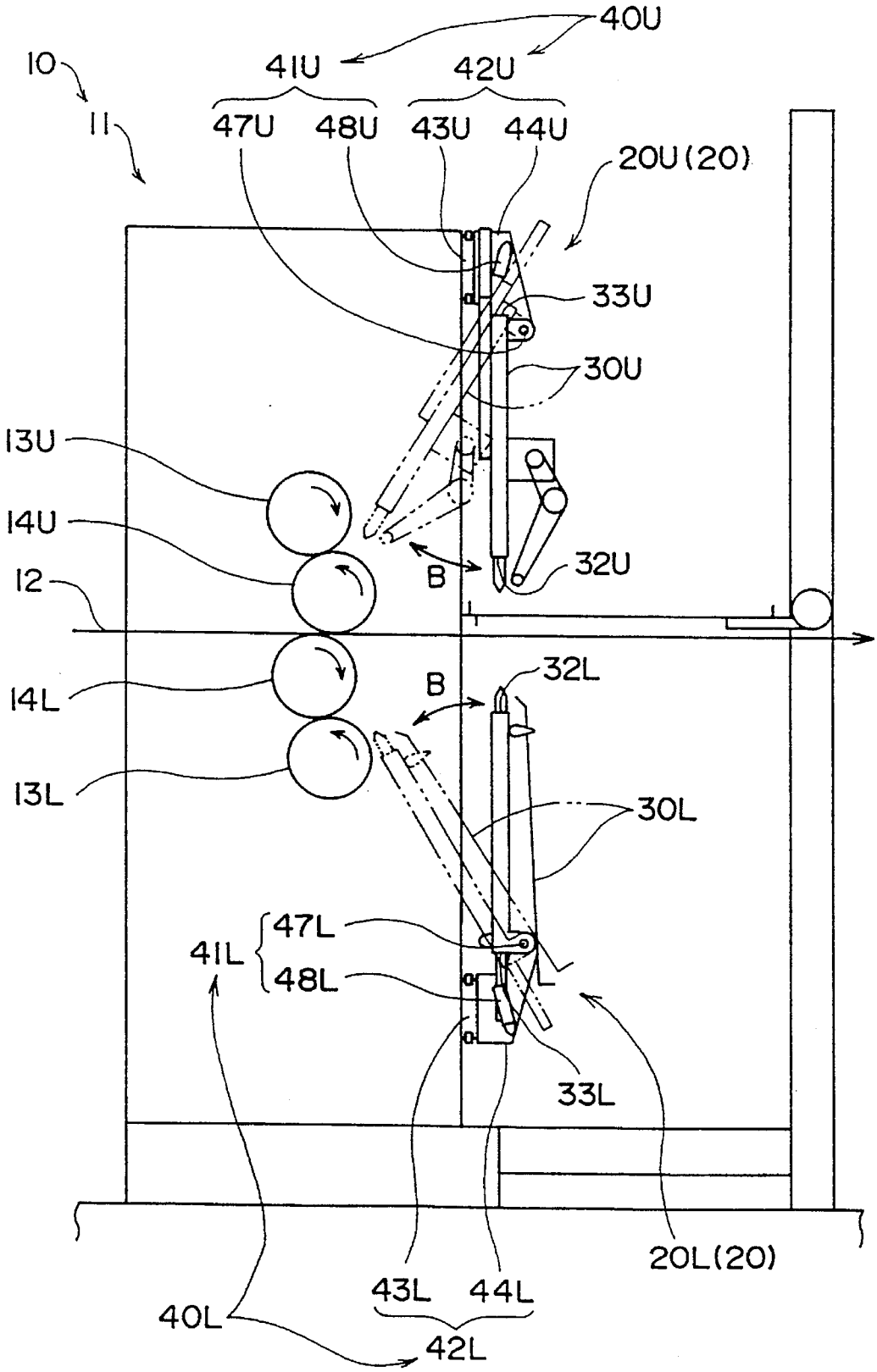
FIG. 1 is a vertical sectional view of a printing press of a web-offset printing press, which includes an automatic machine-plate change system of a preferable embodiment according to the present invention.
Figure 2:
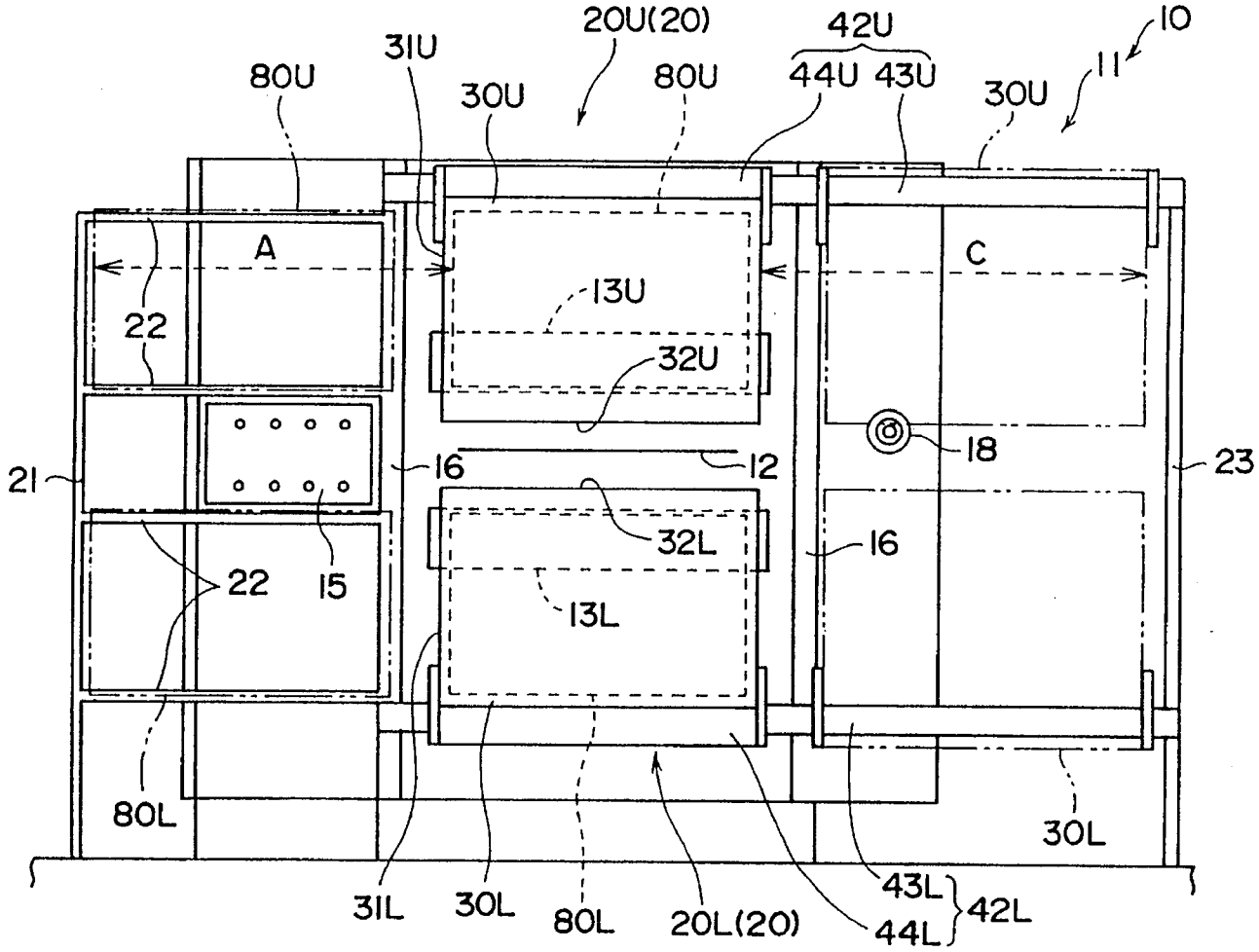
FIG. 2 is an elevational view in an intersecting direction to FIG. 1 of the embodiment.

FIG. 1 and FIG. 2 respectively show a vertical sectional view of a printing press 11 composing a web-offset printing press 10 and including an automatic machine-plate change system 20 of the present invention, and an elevational view illustrated from an orthogonal direction of FIG. 1.

The web offset printing press 10 includes, generally, the above plural printing presses 11 corresponding to the various colors used, to facilitate multicolor printing on a web (continuous paper) 12 delivered into the printing press.

In FIG. 1, the printing press 11 includes upper and lower plate cylinders 13U, 13L wound with machine-plates, upper and lower blanket cylinders 14U, 14L to print on both sides of the web 12 with ink respectively transferred from the plate cylinders 13U, 13L, and the automatic machine-plate change system 20 for changing machine plates.

The automatic machine-plate change system 20 is composed of an automatic upper plate change device 20U and an automatic lower plate change device 20L corresponding to the upper and lower plate cylinders 13U, 13L.

In FIGS. 1 and 2, the automatic upper plate change device 20U and the automatic lower plate change device 20L respectively include new-plate cassettes 30U, 30L accommodating new-plates 80U, 80L newly delivered to the upper and lower plate cylinders 13U, 13L, and upper and lower movement systems 40U, 40L causing the new- plate cassettes 30U, 30L to move.

As shown in FIG. 2, each new-plate cassette 30L, 30U has the shape of a quadrangle which area is larger than each new-plate 80U, 80L, in the plane state, to be capable of accommodating the new-plates 80U, 80L from edges 31U, 31L as one lateral side (the left side in FIG. 2) of the cassettes 30L, 30U.

In the control side (the left side in FIG. 2) which a control panel 15 of the printing press 11 is provided, four guide bars 22 are arranged in a horizontal direction to be supported at each end by a frame 16 and a support 21 of the printing press 11. The new-plates 80U, 80L are effected to be a change waiting state by supporting each guide bar 22. And, each guide bar 22 is moved to the right direction in FIG. 2 by an operator when the automatic machine plate change takes place in order to guide the new-plates 80U, 80L to accommodate into the new-plate cassettes 30U, 30L. A movement range A of the new-plates 80U, 80L guided by each guide bar 22 is illustrated with an arrow of a dotted line in FIG. 2.

Each movement systems 40U, 40L are composed of upper and lower pendulum systems 41U, 41L causing edges 32U, 32L, located on the side of the plate cylinder 13U, 13L, to move toward and away from the plate cylinders 13U, 13L, by turning the new-plate cassettes 30U, 30L in the direction B shown in FIG. 1, and upper and lower shifting mechanisms 42U, 42L causing the new-plate cassettes 30U, 30L to move along in the axial direction of the plate cylinders 13U, 13L (the fight and left direction in FIG. 2).

The shifting mechanisms 42U, 42L are adapted to causes the new-plate cassettes 30U, 30L to laterally move from a position (the center of FIG. 2) where the plate cylinders 13U, 13L to a position (the right side in FIG. 2) where a line shaft connecting plural printing presses 11 with one another and so on are provide in the transmission side by moving the new-plate cassettes 30U, 30L within a shift range C illustrated with a dotted line in FIG. 2.

The shifting mechanisms 42U, 42L are composed of upper and lower guide rails 43U, 43L arranged to be supported by a support 23 oriented in the transmission side of the printing press 11 and the frame 16 of the printing press 11, upper and lower carriages 44U, 44L rotatably supporting the edges (opposite side of the plate cylinders 13U, 13L) 33U, 33L mutually facing the edges 32U, 32L of the new-plate cassettes 30U, 30L and also guided to slide through rollers 46 along the guide rails 43U, 43L, and shift driving means 45U, 45L (not-shown) causing the carriages 44U, 44L to move. The shift driving means 45U, 45L can be composed of, for example, a driving source such as an electric motor or cylinder device, various driving transfer parts, such as gear and belt, connecting the driving source and the carriages 44U, 44L. The shift driving means 45U, 45L may be contained in the carriages 44U, 44L which will cause the rollers 46 to rotate.

The pendulum systems 41U, 41L are composed of pendulum shafts 47U, 47L rotatably connecting the carriages 44U, 44L with the new-plate cassettes 30U, 30L and air cylinder devices 48U, 48L as a pendulum driving means causing the new-plate cassettes 30U, 30L to pivot on the pendulum shafts 47U, 47L. Incidentally, the pendulum driving means is not limited to use the air cylinder devices 48U, 48L but may use the driving source such as the electric motor.

Figure 3:
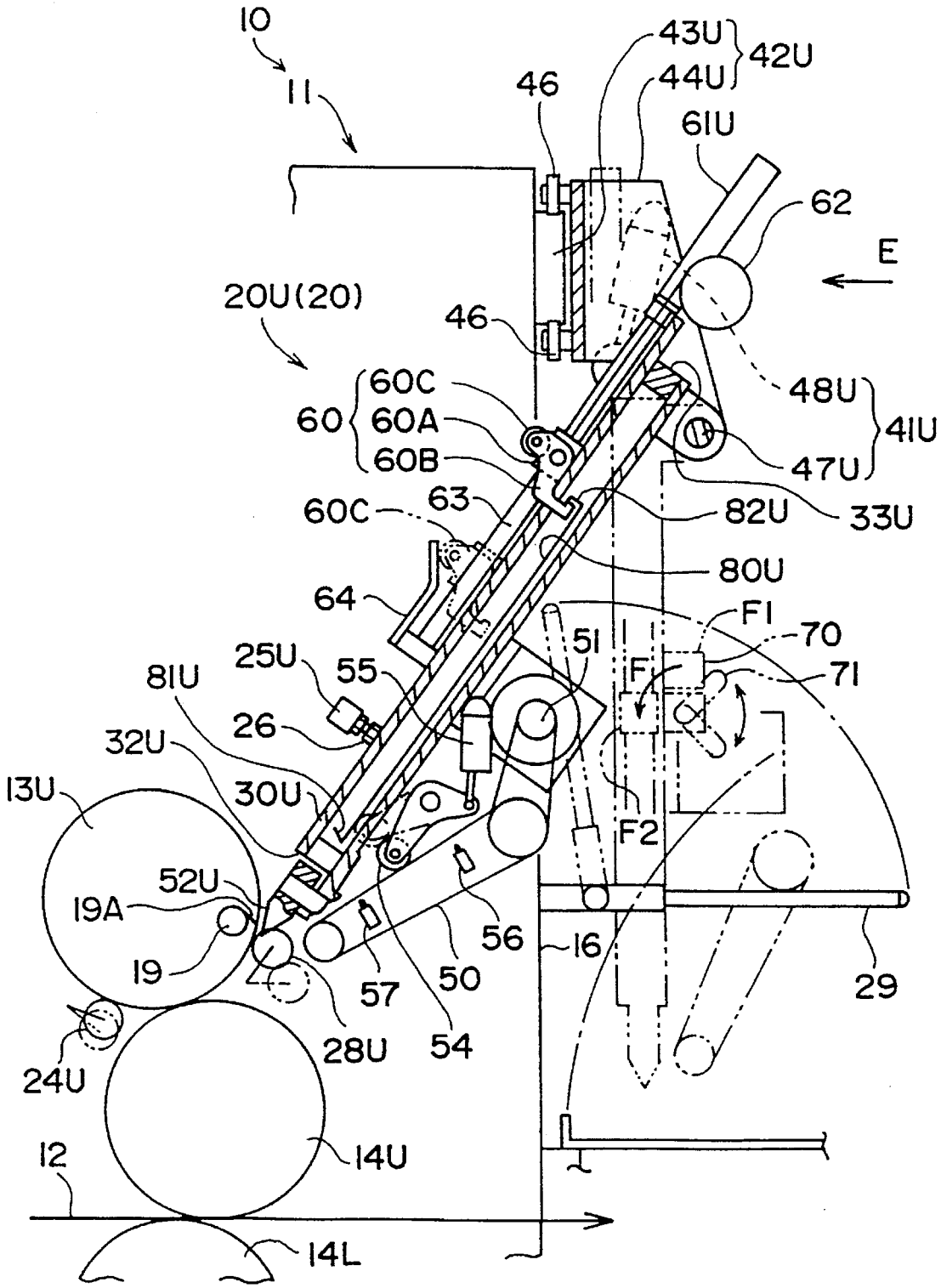
FIG. 3 is an enlarged detail view of an automatic upper machine-plate change device of the embodiment.
Figure 4:
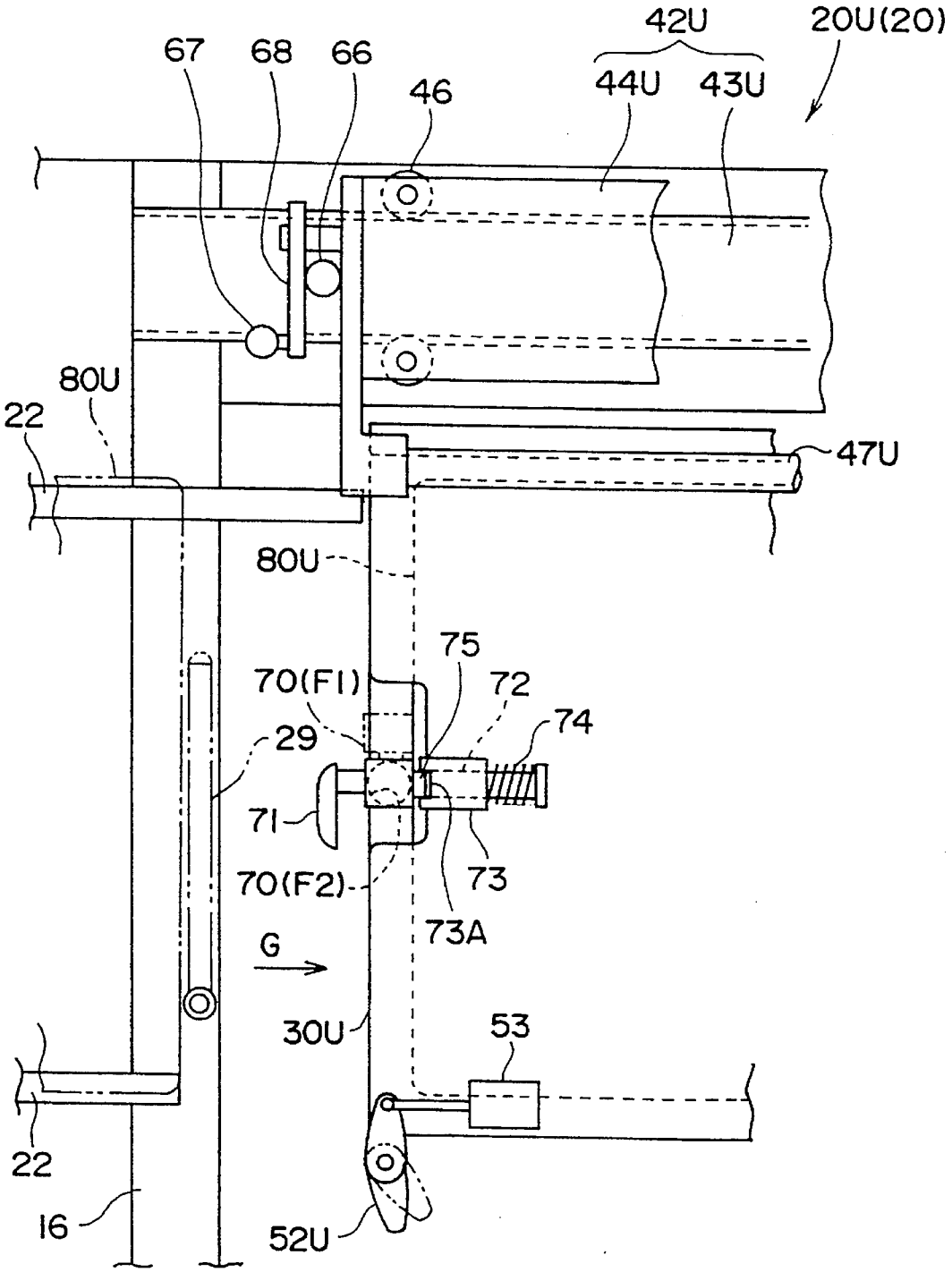
FIG. 4 is another enlarged detail view of an automatic upper machine-plate change device of the embodiment.

FIG. 3 and FIG. 4 both show an enlarged detailed view of the automatic upper plate change device 20U. FIG. 4 is a drawing of the automatic upper plate change device 20U seen from the direction of an arrow E in FIG. 3.

In FIG. 3, a roller 24U acting as a rear weight and a roller 28U acting as a front weight, which are arranged to rotatably touch with the machine plate wound on the plate cylinder 13U, are detachably provided under the plate cylinder 13U. The aforementioned rear weight roller 24U and the front weight roller 28U are moved to touch to the plate cylinder 13U by the air cylinder device (not-shown) and so on when a used-plate 90U is removed from the plate cylinder 13U or when the new-plate 80U is wound on the plate cylinder 13U, so that the weight rollers 24U, 28U are adapted to press the machine plate (the used-plate 90U or the new-plate 80U) onto the plate cylinder 13U at the position where the rollers are provided. And furthermore, the rear weight roller 24U and the from weight roller 28U are attached to the frame 16 of the printing press 11.

In the right upper side of the plate cylinder 13U in FIG. 3, a stopper 25U is provided to abut to the new-plate cassette 30U to stop the new-plate cassette 30U from making a turn caused by the pendulum system 41 U. And, an adjusting nut 26, in order to adjust a stop position, is provided on the abutting face of the stopper 25U.

On the right side of FIG. 3, a protector 29 is provided on the frame 16 of the printing press 11. The protector 29 is adapted to be turned from an accommodated state, illustrated with a dotted line in FIG. 3, to a horizontally unfolded state in order to prevent an operator from approaching the side of the plate cylinder 13U from the protector 29 during the operation of the automatic machine-plate change.

Next to the bottom edge 32U of the new-plate cassette 30U, a belt conveyor 50 for carrying the used-plate 90U out is provided, having its belt rotatably driven by a belt conveyor driving means 51. The belt conveyor 50 is fixed to the new-plate cassette 30U to be rotated with the new-plate cassette 30U by the pendulum system 41U.

Figure 10:
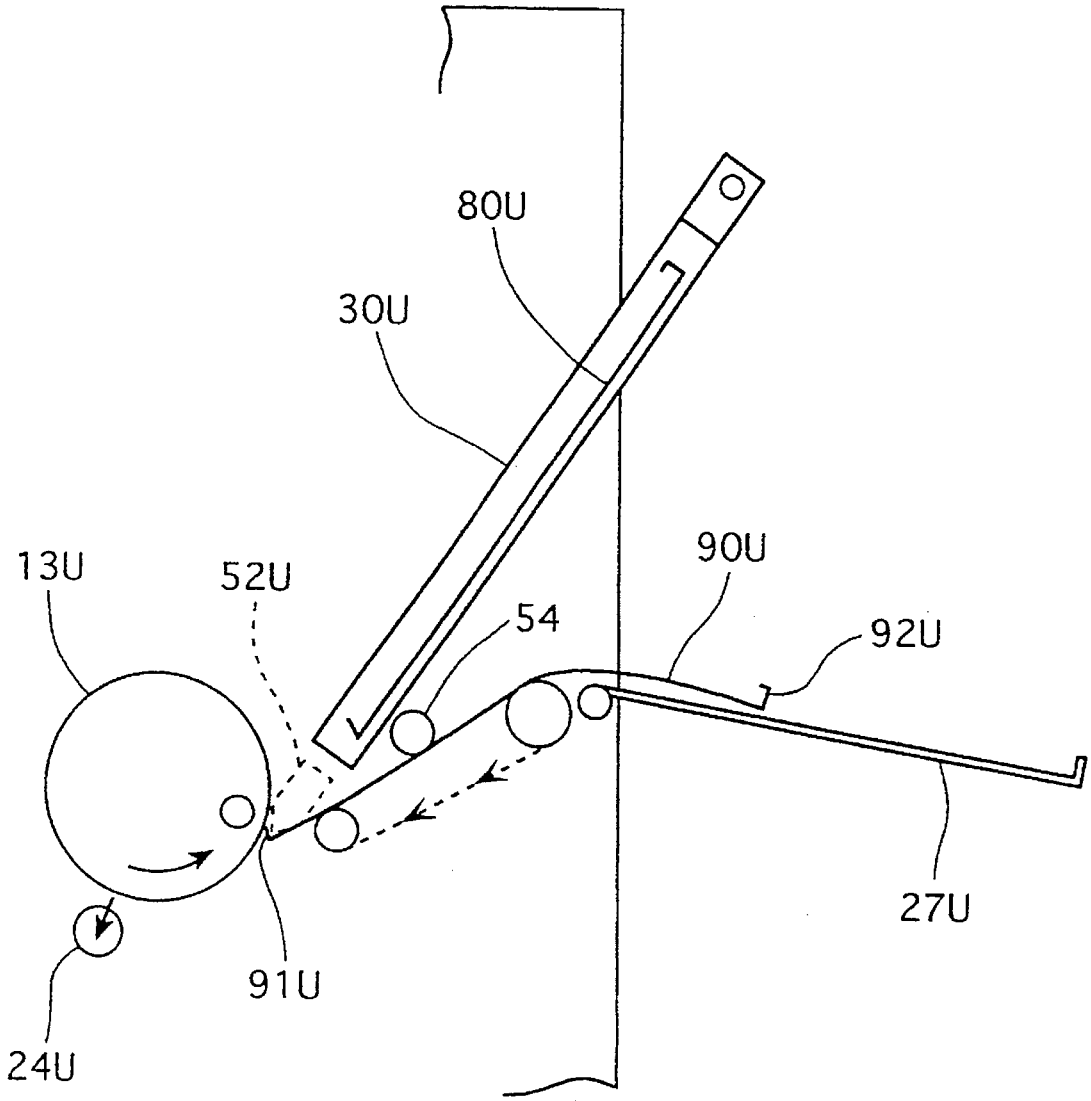
FIG. 10 is a fifth operational explanation view of the automatic machine-plate change system of the embodiment.
Figure 11:
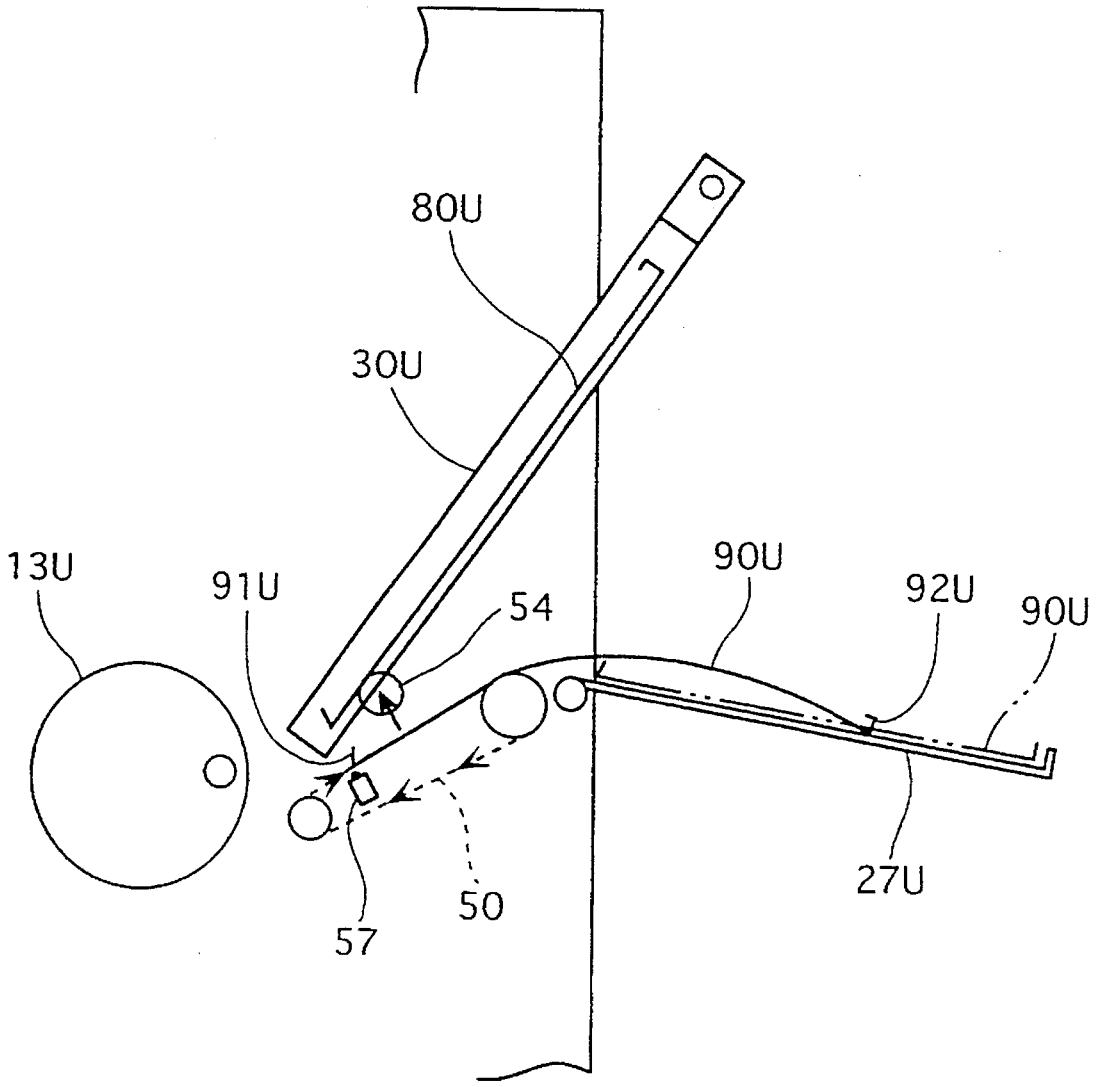
FIG. 11 is a sixth operational explanation view of the automatic machine-plate change system of the embodiment.

In the downstream of the carrying direction of the belt conveyor 50, a used-plate receiver 27U is provided to receive the used-plate 90U delivered by the belt conveyor 50 after the used-plate 90U is peeled from the plate cylinder 13U (see FIG. 10 and FIG. 11). The used-plate receiver 27U is adapted to be fixed to the new-plate cassette 30U to be moved with the new-plate cassette 30U.

Under the bottom edge 32U of the new-plate cassette 30U, a plate head peeler 52U peeling a used-plate head 91U of the used-plate 90U from the plate cylinder 13U is provided. The plate head peeler 52U is adapted so that its end is projected toward the plate cylinder 13U, as a result of being rotated by an air cylinder device 53 fixed on the new-plate cassette 30U when the used-plate 90U is taken off (see FIG. 4).

Between the belt conveyor 50 and the new-plate cassette 30U, a clamp conveyance roller 54 is detachably provided. The clamp conveyance roller 54 is adapted to be rotated in the direction of the belt conveyor 50 by a cylinder device 55 to cause the used-plate 90U to press to the belt conveyor 50.

Next to the belt conveyor 50 and in the downstream of the carried direction from a position where the clamp conveyance roller 54 is provided, a foot pass detecting sensor 56, which detects passing a used-plate foot 92U of the used-plate 90U, is provided.

And next to the belt conveyor 50 and in the upstream of the carried direction from a position where the clamp conveyance roller 54 is provided, a head pass detecting sensor 57, which detects passing a used-plate head 91U of the used-plate 90U, is provided.

The foot pass detecting sensor 56 and the head pass detecting sensor 57 are provided in order to control the timing of detaching and attaching the clamp conveyance roller 54.

On the left side of the new-plate cassette 30U in FIG. 3, a new-plate foot gripper 60 supporting to hook a new-plate foot 82U of the new-plate 80U accommodated in the new-plate cassette 30U is provided. Furthermore, up the new-plate foot gripper 60, a new-plate delivery air-cylinder device 61U, which delivers the new-plate 80U to the plate cylinder 13U by causing the new-plate foot gripper 60 to move along the new-plate cassette 30U, and a tensional reel 62, which pulls the new-plate foot gripper 60 in a different direction from the delivering direction caused by the new-plate delivery aircylinder device 61U, are provided. These new-plate delivery air-cylinder device 61U and tensional reel 62 are oriented to the new-plate cassette 30U to be rotated with the new-plate cassette 30U by pendulum system 41U.

The new-plate foot gripper 60 is composed of a gripper body 60A, which is slidably guided by a guide bar 63 arranged along the left side of the new-plate cassette 30U in FIG. 3, a grip portion 60B, which is rotatably fitted to the gripper body 60A and has a hook to hook the new-plate foot 82U of the new-plate 80U at its end, and a cam follower 60C, which is rotatably fitted to the grip portion 60B.

On the left side of the new-plate cassette 30U in FIG. 3, a grip release cam 64 abutting to the cam follower 60B of the new-plate foot gripper 60 is fastened. That is, the cam follower 60C is abutted to the grip release cam 64 when the new-plate foot gripper 60 is moved to the position of the grip release cam 64 (the position illustrated with a double dotted line in FIG. 3 ), with the result that the end of grip portion 60B of the new-plate foot gripper 60 is taken off from the new-plate foot 82U of the new-plate 80U.

On the guide rail 43U in FIG. 4, an eccentric shaft 66 is oriented in a direction lying at right angle to the lengthwise direction of the guide rail 43U (an intersectant direction on paper). The eccentric shaft 66 is provided for deciding a stop position of the shifting carriage 44U by abutting to the side of the carriage 44U. By rotating the eccentric shaft 66, the stop position of the carriage 44U is adjusted in fight and left direction as in the drawing, and then a side phase (a position against in axial direction of the plate cylinder 13U) of the new-plate 80U accommodated in the new-plate cassette 30U is adapted to be adjusted.

On the side of the carriage 44U, a clamp 68 having a handle 67 at its end is provided. The clamp 68 is adapted to be capable of fastening the carriage 44U, in an abutting state, to the eccentric shaft 66 by causing the eccentric shaft 66 to be clamped between the side of the carriage 44U and the handle 67 by turning the handle 67.

The eccentric shaft 66 and the clamp 68 are provided in the automatic lower machine-plate change device 20L as well.

As for FIG. 3 and FIG. 4, on the right side of the new-plate cassette 30U in FIG. 3, a side press roller 70 is provided to press an edge (link between the new-plate head 81U and the new-plate foot 82U) of the control side of the new-plate 80U into the transmission side. The side press roller 70 is adapted to be abutted to the edge of the new-plate 80U by being rotated in a direction F shown in FIG. 3 by a turned handle 71 (an abutment state F2). Further, the side press roller 70 is adapted to be distanced from a position of a new-plate insert opening, formed on the edge 31U of the new-plate cassette 30U, when the new-plate 80U is inserted into the new-plate cassette 30U (a refuge state F1).

In FIG. 4, a rotation shaft 72 of the side press roller 70 is capable of slidably moving in fight and left direction to a fixing portion 73 fixed to the new-plate cassette 30U in the drawing and is put close to the transmission side (on the right side of the drawing) by a spring 74 at all times. A projection portion 75 rotating with the rotation shaft 72 is fixed to the rotation shaft 72. On the other hand, a concave 73A capable of accommodating the projection portion 75 is formed in the fixing portion 73. The projection portion 75 is caught into the concave 73 A at a position where the side press roller 70 becomes to be the abutment state F2, therefore the rotation shaft 72 is moved to the transmission side, with the result that the new-plate 80U is pressed to the transmission side by the side press roller 70.

The aforementioned side press roller 70 and each part around the side press roller 70 are provided in the new-plate cassette 30L of the automatic lower machine-plate change device 20L as well.

Figure 5:
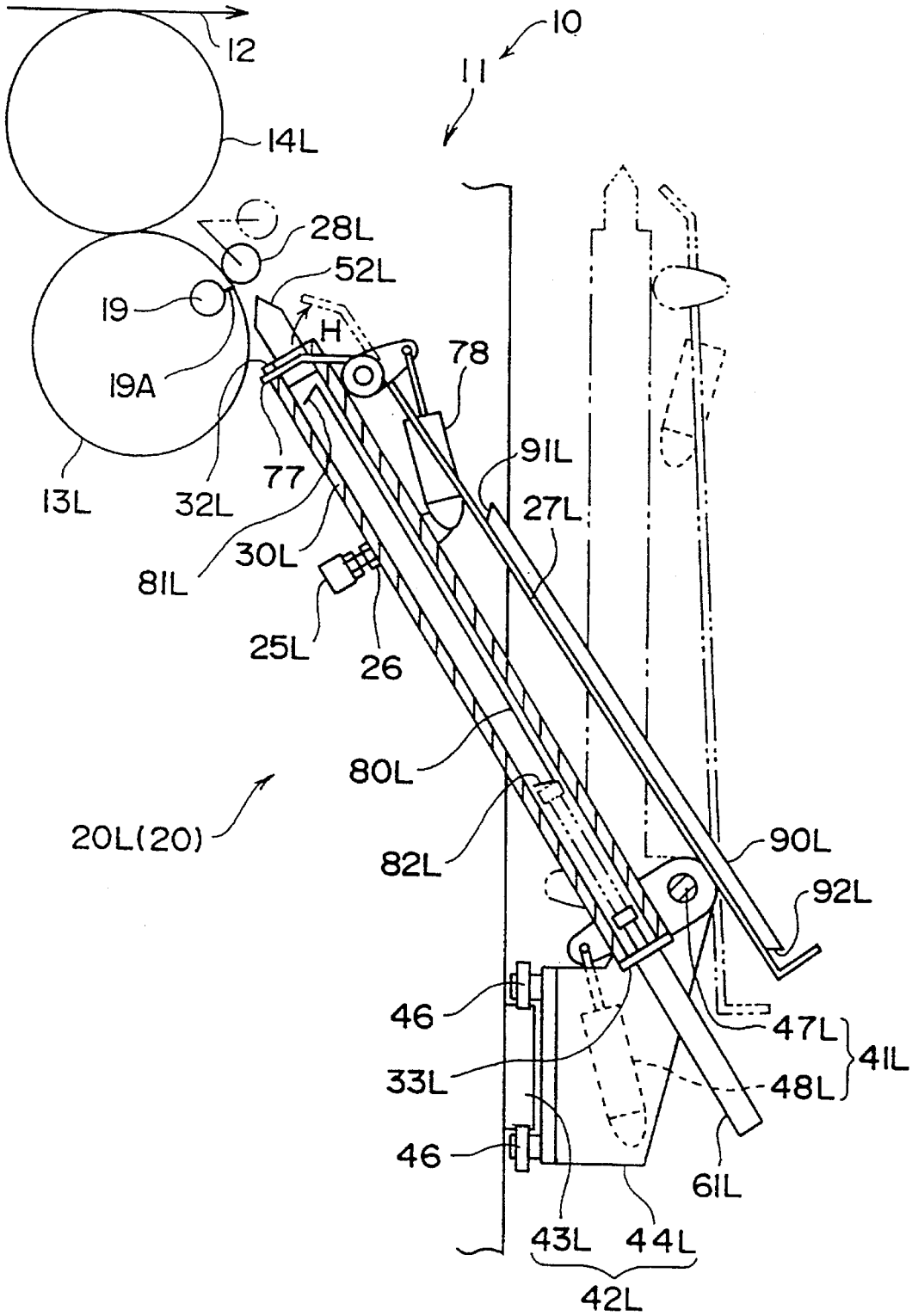
FIG. 5 is an enlarged detail view of an automatic lower machine-plate change device of the embodiment.

FIG. 5 shows an enlarged detailed diagram of the automatic lower machine-plate change device 20L.

In FIG. 5, a weight roller 28L is detachably oriented up the right side of the plate cylinder 13L to rotatably touch to the machine plate wound on the plate cylinder 13L. The weight roller 28L is moved to touch to the plate cylinder 13L by the air cylinder device (not-shown) and so on when the new-plate 80L is wound around the plate cylinder 13L, so that the roller 28L is adapted to press the machine plate onto the plate cylinder 13L at the position where the roller is provided. And furthermore, the weight roller 28L is attached to the frame 16 of the printing press 11.

On the right downward side of the plate cylinder 13L in FIG. 3, a stopper 25L is provided to stop the new-plate cassette 30L from making a turn caused by the pendulum system 41L by abutting the new-plate cassette 30L. And, the adjusting nut 26 in order to adjust a stop position is provided on the abutting face of the stopper 25L.

A plate head peeler 52L peeling a used-plate head 91L of the used-plate 90L from the plate cylinder 13L is provided on an edge 32L of the new-plate cassette 30L. The plate head peeler 52L has the same structure and function as the aforementioned plate head peeler 52U of the automatic upper machine-plate change device 20U.

Under an edge 33L of the new-plate cassette 30L, a new-plate delivery aircylinder device 61L is provided to push the new-plate foot 82L of the new-plate 80L accommodated in the new-plate cassette 30L in order to deliver the new-plate 80L to the plate cylinder 13L.

On the right side of the new-plate cassette 30L in FIG. 5, a used-plate receiver 27L, which receives the used-plate 90L removed from the plate cylinder 13L, is arranged along the new-plate cassette 30L. The used-plate receiver 27L is turned with the new-plate cassette 30L by the pendulum system 41L.

Next to the upper end of the used-plate receiver 27L, a plate head kick-pin 77, which guides the used-plate head 91L of the used-plate 90L upward, and an air cylinder device 78, which causes the plate head kick-pin 77 to turn in a direction H in the drawing, are oriented.

In regards to FIG. 3 and FIG. 5, in the plate cylinders 13U, 13L, catch shafts 19 which catches the edges of the machine plates to cause the machine plates to wind around the circumferential surface of the plate cylinder 13U, 13L, are respectively provided. The catch shaft 19 is adapted to be rotatably driven by a catch shaft driving means (not-shown). A driving means disclosed in Japanese Patent Application Laid-open No. Hei 5-2460 13, by the same applicant, can be used as the aforementioned catch shaft driving means.

In the embodiment as described thus far, the automatic machine-plate change for the upper and lower plate cylinders 13U, 13L will take place as follows.

[AUTOMATIC MACHINE-PLATE CHANGE FOR LIPPER PLATE CYLINDER 13U BY AUTOMATIC LIPPER MACHINE-PLATE CHANGE DEVICE 20U]

First, the new-plate 80U to be newly prepared on the plate cylinder 13U waits at the control side of the printing press 11 in a supported state by the guide bar 22.

In parallel with the new-plate 80U to be in the waiting state, after the new-plate cassette 30U is automatically shifted to the central position (in a state illustrated with a solid line in FIG. 2) from the transmission side (in a state illustrated with a double dotted line in FIG. 2) of the printing press 11 by the shifting mechanism 42U driven by the shift driving means 45U, an operator fixes the carriage 44 with the clamp 68, deciding a position of the new-plate cassette 30U in the shift direction.

The operator makes the protector 29 to be in an OFF state (in a state illustrated with a double dotted line in FIG. 3), and moves the new-plate 80U in the waiting state to a direction G in FIG. 4 by using the guide bar 22 in order to insert the new-plate 80U into the new-plate cassette 30U.

Figure 6:
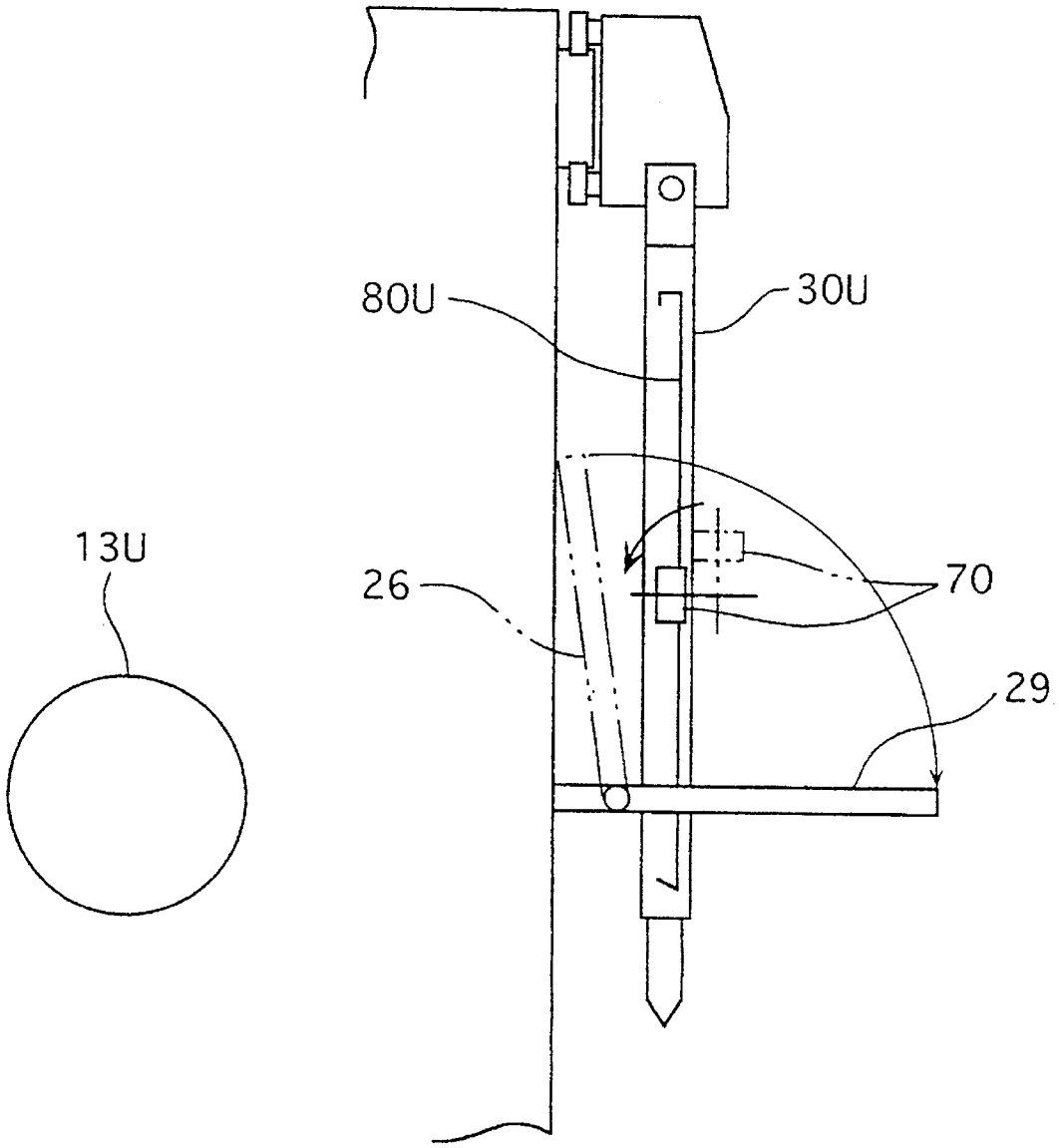
FIG. 6 is a first operational explanation view of the automatic machine-plate change system of the embodiment.

Next, as being shown in FIG. 6, after the new-plate 80U is pressed to the transmission side by the side press roller 70 brought under an ON state (a state illustrated with a solid line in FIG. 6), the operator horizontally puts the protector 29 to be in the ON state (a state illustrated with a solid line in FIG. 6) and finishes arranging for the automatic machine-plate change.

Figure 7:
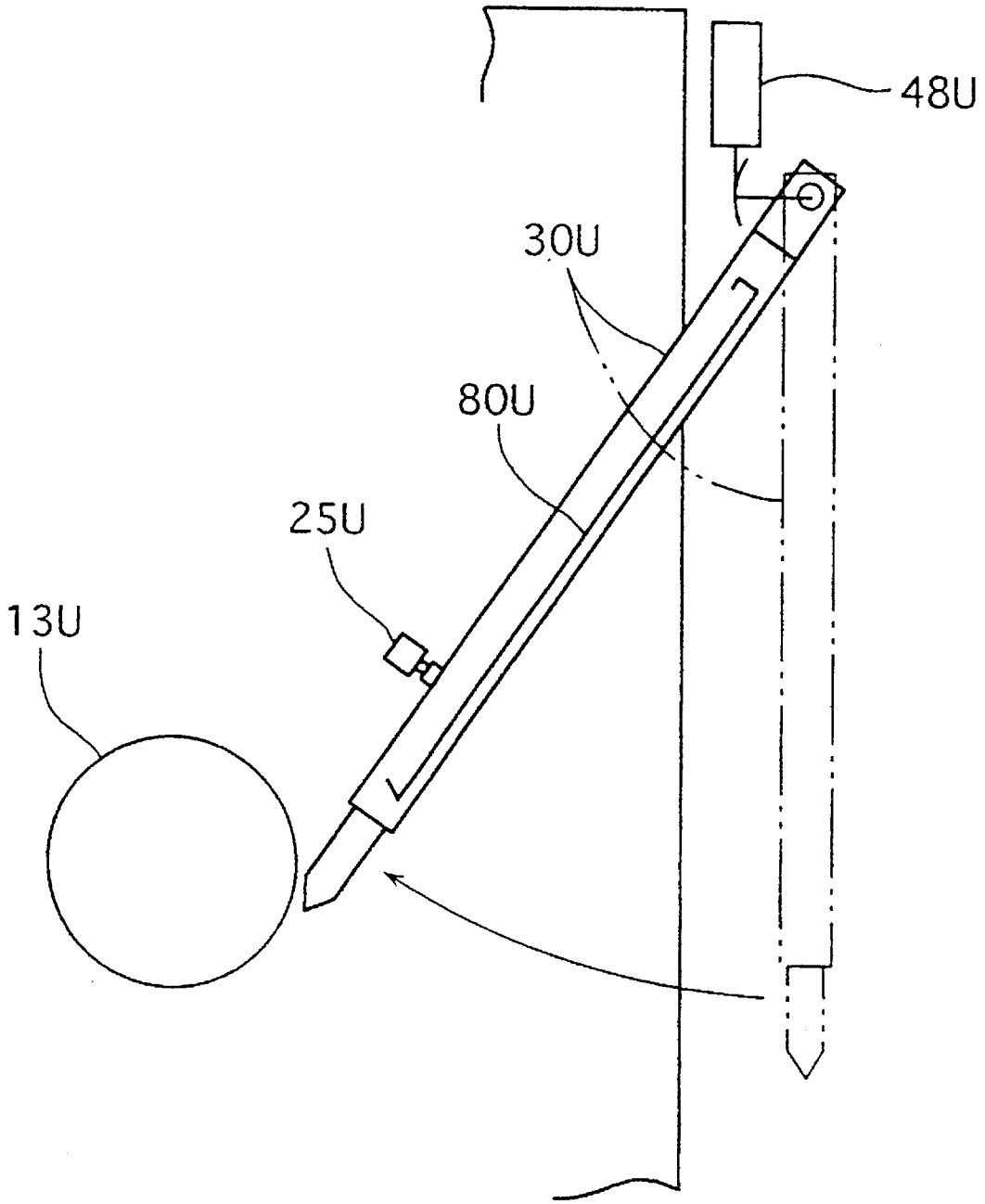
FIG. 7 is a second operational explanation view of the automatic machine-plate change system of the embodiment.

As being shown in FIG. 7, the air cylinder device 48U causes the pendulum system 41U to cause the new-plate cassette 30U to automatically turn from a vertical state (a state illustrated with a double dotted line in the drawing) to a position abutted to the stopper 25U (a state illustrated with a solid line in the drawing).

Figure 8:
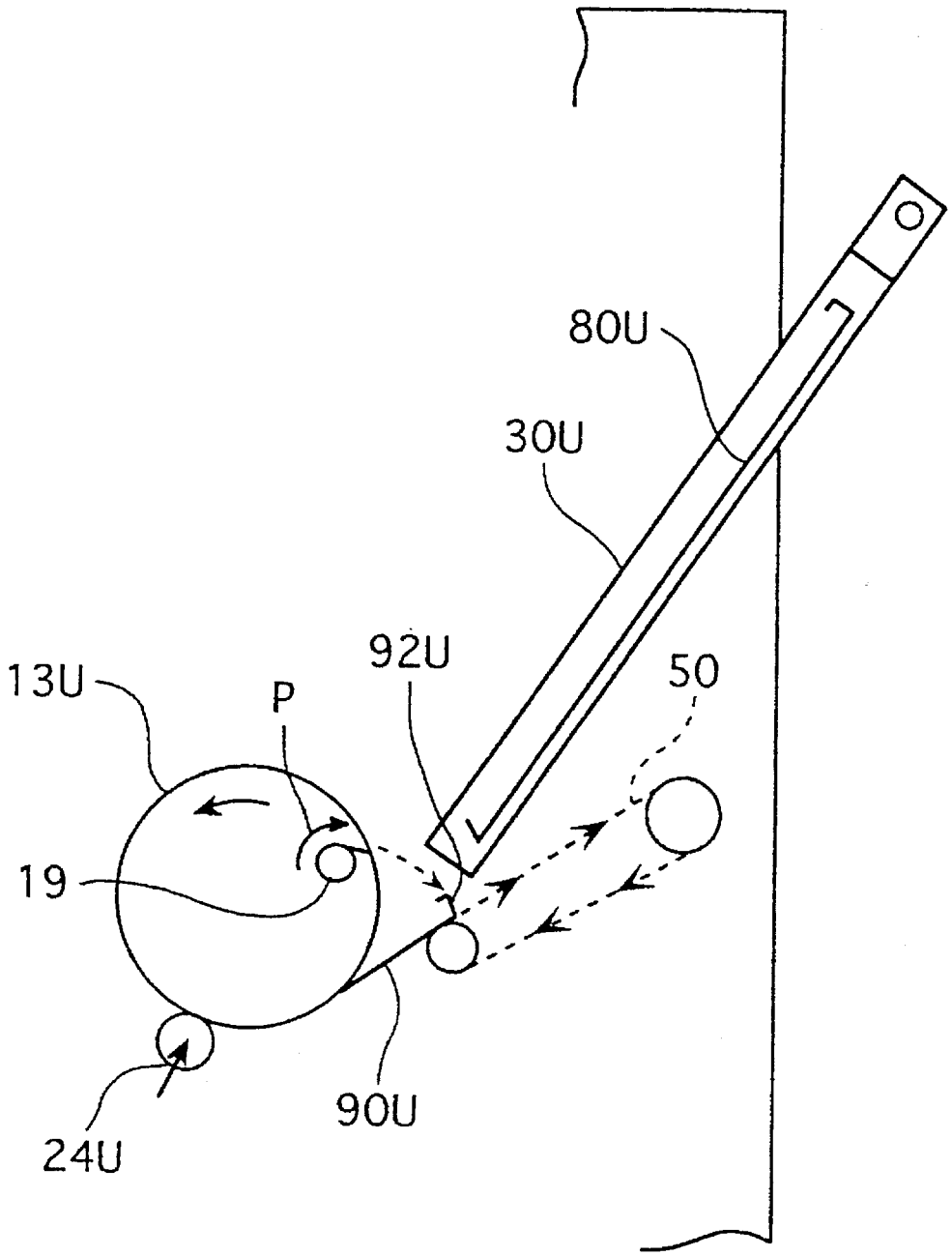
FIG. 8 is a third operational explanation view of the automatic machine-plate change system of the embodiment.

As being shown in FIG. 8, the plate cylinder 13U is rotated in a wrong direction, and when the catch shaft 19 reaches a predetermined plate removal position, the catch shaft 19 is rotated in a direction P, in the drawing, to be able to automatically release a catch engagement of the used-plate 90U, causing the used-plate foot 92U of the used-plate 90U to jump out of the plate cylinder 13U. Incidentally, when the catch shaft 19 is rotated until the predetermined plate removal position, the plate cylinder 13U may be rotated in a right direction. Furthermore, when the catch shaft 19 reaches the predetermined plate removal position, the plate cylinder 13U may be interrupted or may continue to rotate in the wrong direction without interruption, moving in a state in FIG. 9 which will be set forth in detail below.

In parallel with the release by the catch shaft 19, while the used-plate 90U is supported to fall down by the rear weight roller 24U which is forcibly pressed on the plate cylinder 13U to be in an attaching state, driving of the belt conveyor 50 is started.

Figure 9:
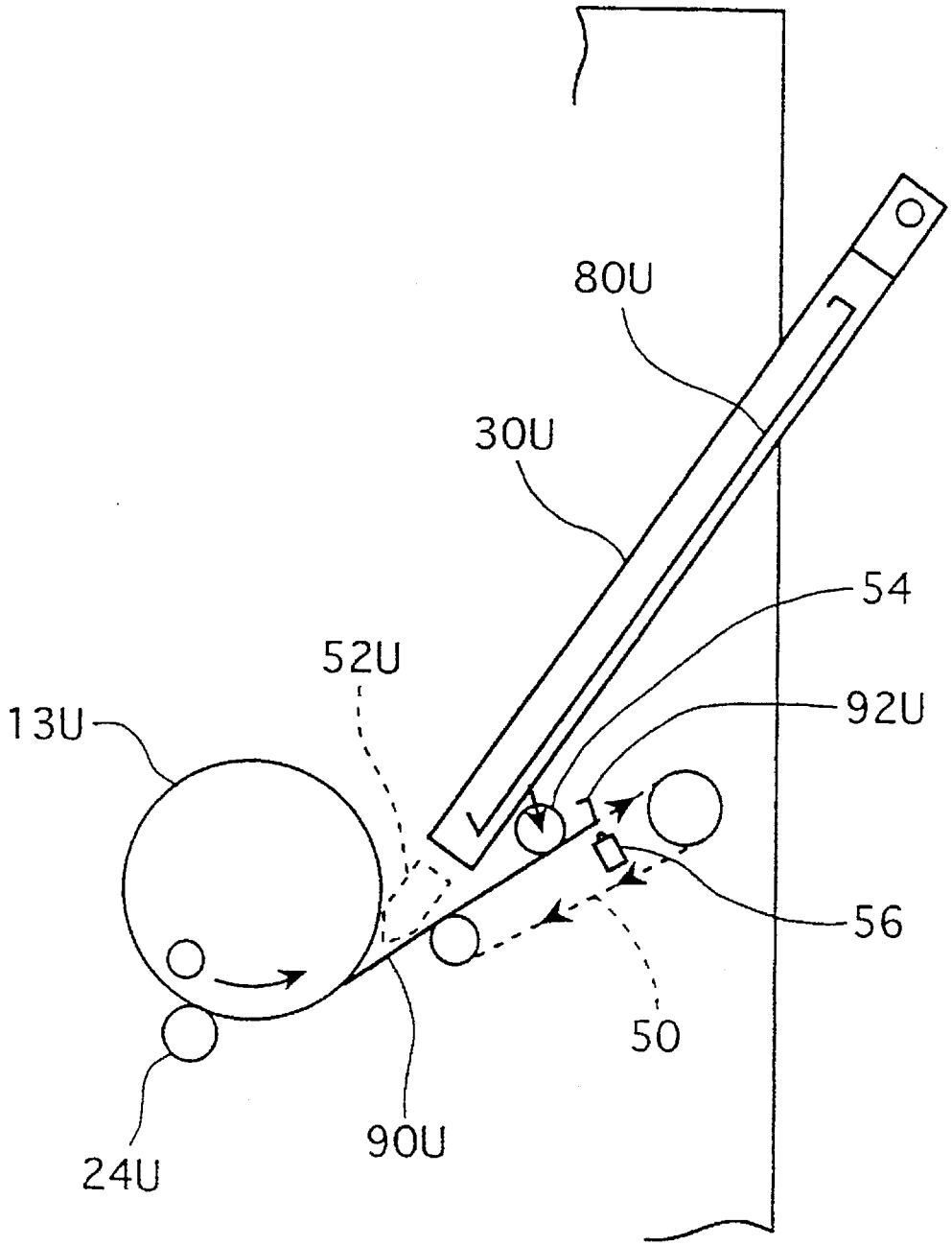
FIG. 9 is a fourth operational explanation view of the automatic machine-plate change system of the embodiment.

Then as being shown in FIG. 9, after the used-plate 90U is peeled from the plate cylinder 13U bit by bit during the rotation of the plate cylinder 13U in the wrong direction and driving of the belt conveyor 50, and the foot pass detecting sensor 56 detects the passing of the used-plate foot 92U of the used-plate 90 to ascertain that the used-plate foot 92U passes through the position of the clamp conveyance roller 54, the clamp conveyor roller 54 becomes in an attaching state to cause the used-plate 90U to press to the belt conveyor 50, and at the same time, the plate head peeler 52U is turned and its end is projected toward the plate cylinder 13U.

As known from FIG. 10, while the plate head peeler 52U is turned away from the plate cylinder 13U after peeling the used-plate head 91U of the used-plate 90U with a hook from the plate cylinder 13U, the rear weight roller 24U becomes in a detaching state, detaching from the plate cylinder 13U.

As being shown in FIG. 11, with detecting the passing of the used-plate head 91U of the used-plate 90U by the head pass detecting sensor 57, just before the used-plate head 91U passes through the position of the clamp conveyance roller 54, the clamp conveyance roller 54 becomes in the detaching state, detaching from the used-plate-90U, and simultaneously, the rotation of the plate cylinder 13U in the wrong direction is interrupted. After the used-plate 90U passes through the belt conveyor 50 and is delivered to the used-plate receiver 27U, the belt conveyor 50 is stopped, and then the removal and delivery of the used-plate 90U is finished.

After the removal and delivery of the used-plate 90U is finished, delivery of the new-plate 80U onto the plate cylinder 13U starts.

Figure 12:
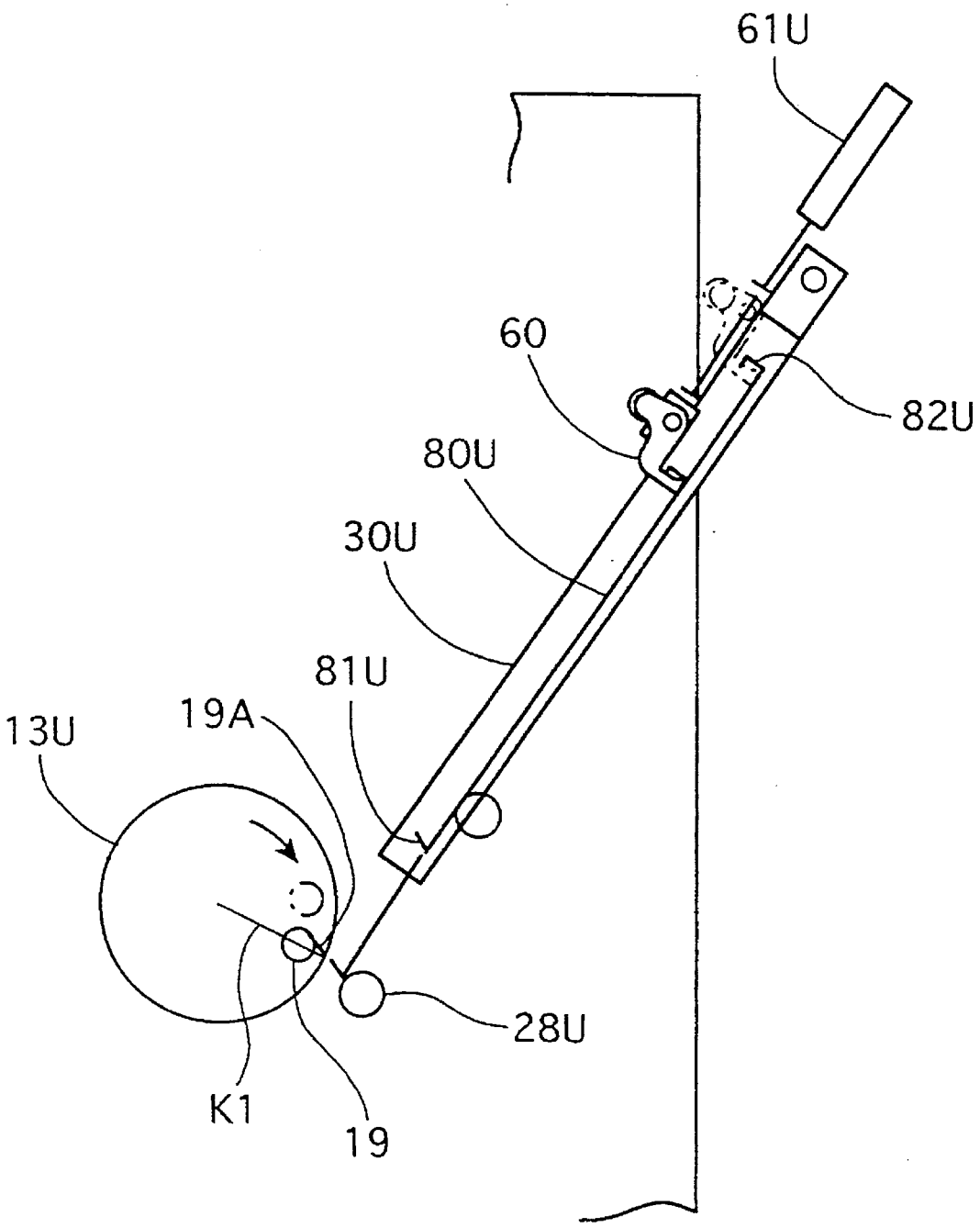
FIG. 12 is a seventh operational explanation view of the automatic machine-plate change system of the embodiment.

First, as being known from FIG. 12, the new-plate 80U, which is supported by the new-plate foot gripper 60 and the tensional reel 62, is sent downward by the new-plate delivery air-cylinder device 61U until the new-plate head 81U of the new-plate 80U reaches the position of the front weight roller 28U, and the plate cylinder 13U is stopped when a catch groove 19A provided at the catch shaft 19 on the circumferential surface of the plate cylinder 13U reaches a position (K1) just before meeting with the new-plate head 81U after the plate cylinder 13U starts rotating in the right direction.

Figure 13:
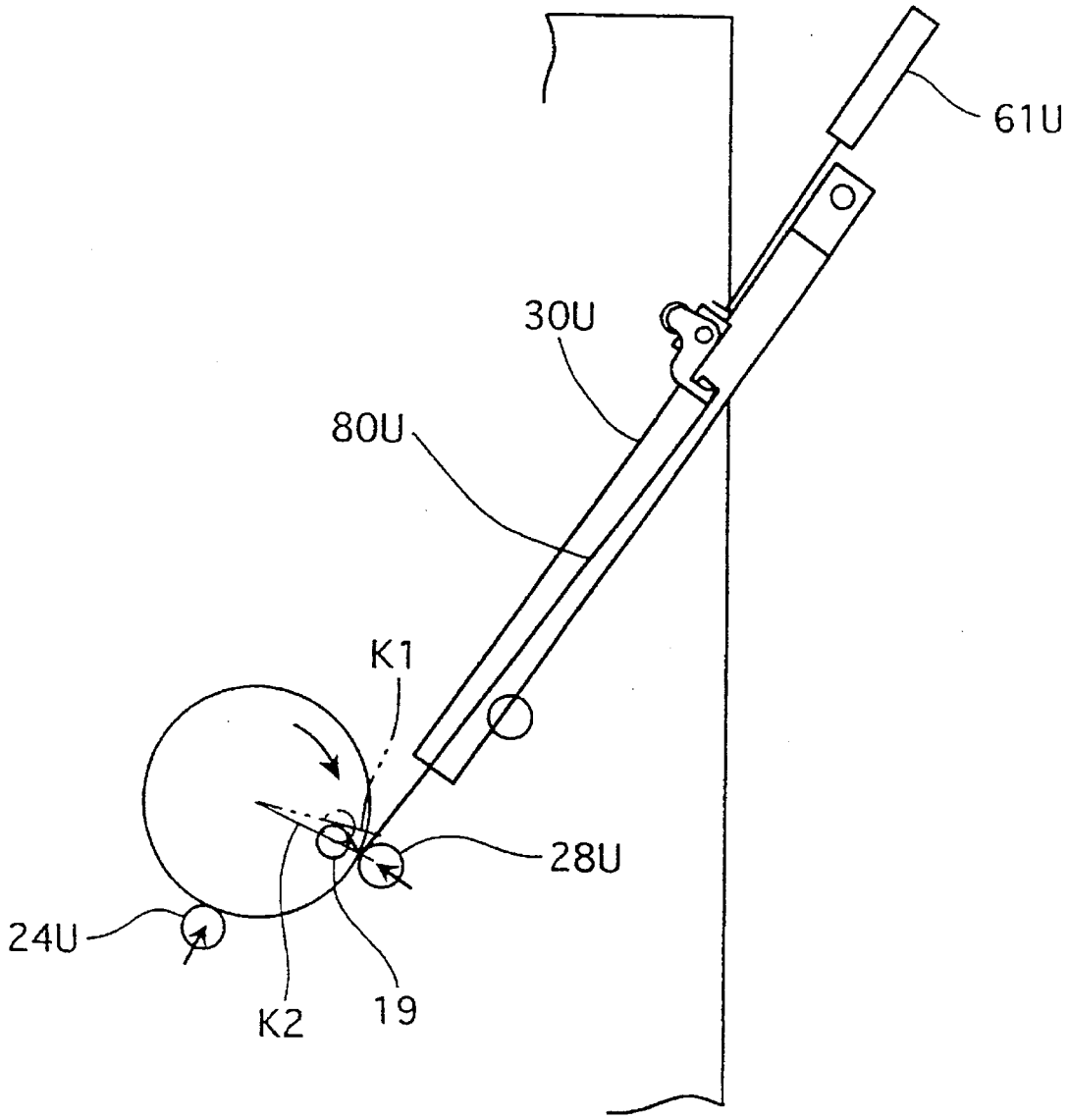
FIG. 13 is an eighth operational explanation view of the automatic machine-plate change system of the embodiment.

Next, as being shown in FIG. 13, the plate cylinder 13U starts rotating in the right direction at a low speed from the position K1, and simultaneously, the front weight roller 28U and the rear weight roller 24U become in the attaching state to be rotatably moved toward the plate cylinder 13U. And, the plate cylinder 13U continues rotating in the right direction at the low speed until the position (K2) where the new-plate head 81U of the new-plate 80U is engaged into the catch groove 19A.

Figure 14:
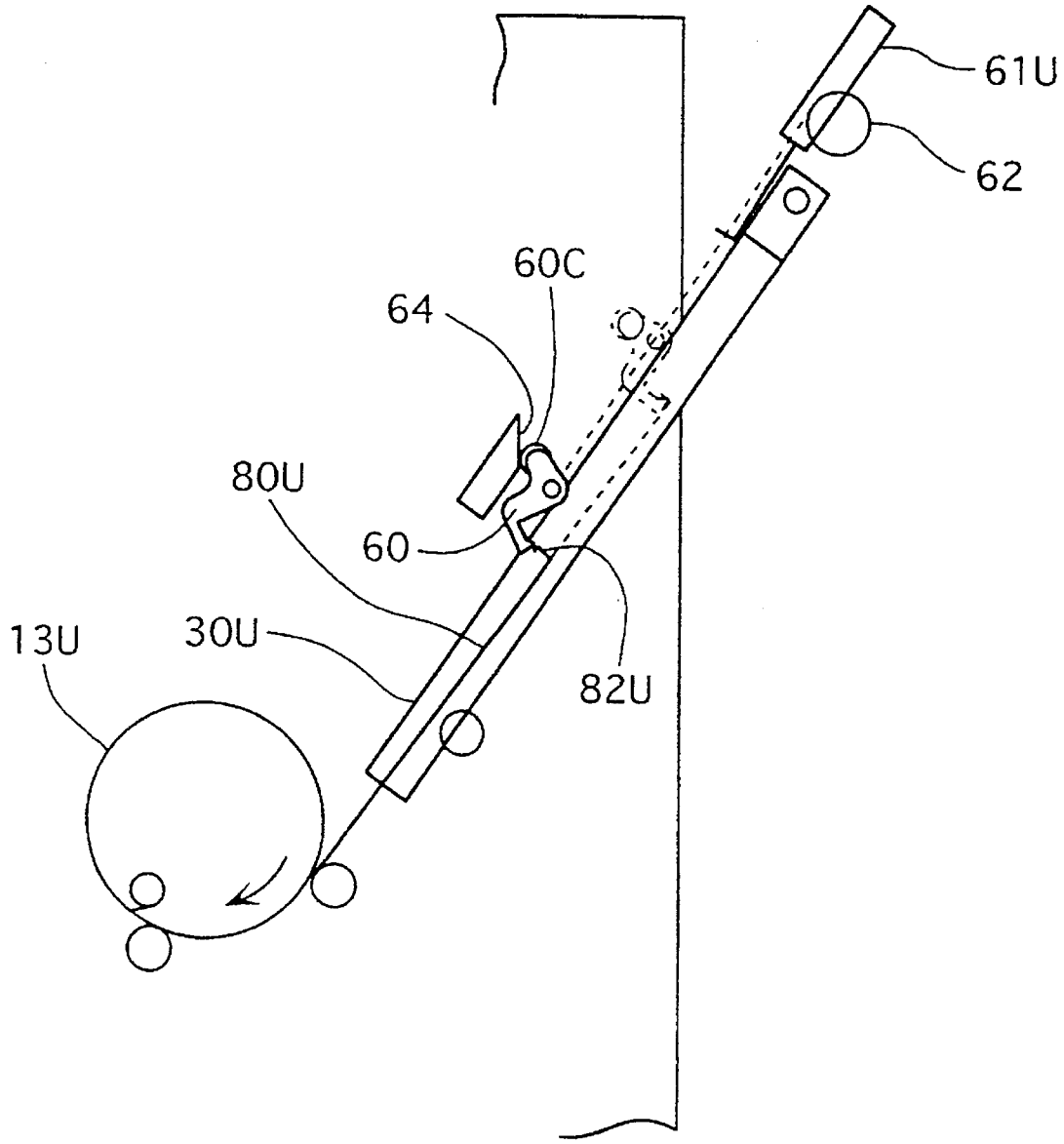
FIG. 14 is a ninth operational explanation view of the automatic machine-plate change system of the embodiment.

As being shown in FIG. 14, the plate cylinder 13U is rotated in the right direction from the position K2, and with maintenance of the tense state of the tensional reel 62, the new-plate 80U is moved downward while being supported by the new-plate foot gripper 60. When the cam follower 60C of the new-plate foot gripper 60 is abutted to the grip release cam 64, the new-plate foot gripper 60 detaches from the new-plate foot 82U of the new-plate 80U, so that the tensional reel 62 becomes in the non-tense state. The new-plate foot gripper is pulled upward by the tensional reel 62, returning to its original position, and at the same time, the new-plate delivery air-cylinder device 61U is returned to its original position.

Figure 15:
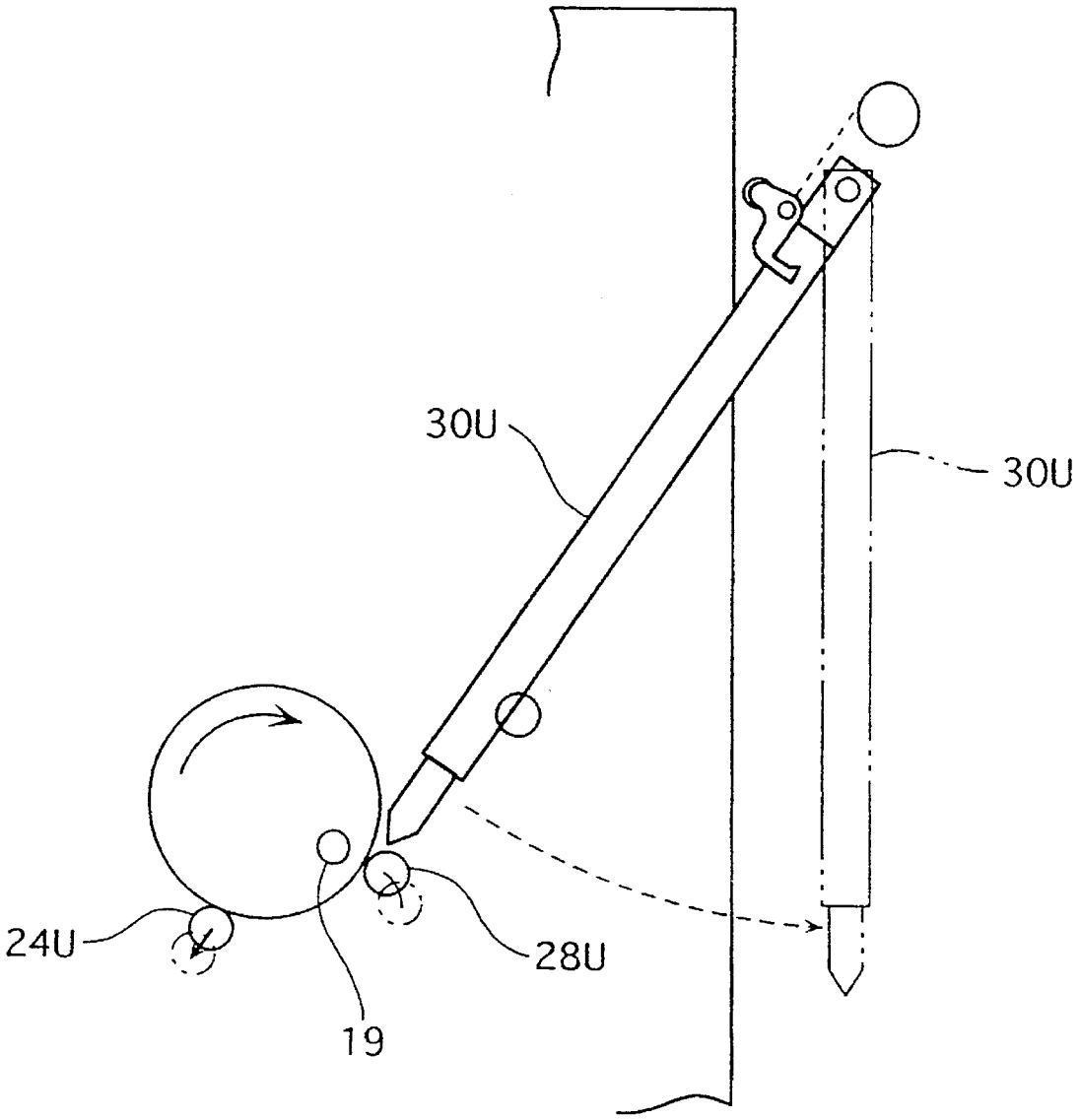
FIG. 15 is a tenth operational explanation view of the automatic machine-plate change system of the embodiment.

Then, as being shown in FIG. 15, the plate cylinder 13U continues rotating in the right direction until the catch shaft 19 reaches the position of the front weight roller 28U, and then when the new-plate foot 82U of the new-plate 80U is engaged into the catch groove 19A, the catch shaft 19 is rotated to wind the new-plate 80U. At the time when the new-plate 80U is completely wound around the plate cylinder 13U, the plate cylinder 13U stops rotating in the fight direction.

After the new-plate is completely wound around the plate cylinder 13U, the front weight roller 28U and the rear weight roller 24U become in the detaching state, detaching from the plate cylinder 13U, and at the same time, the new-plate cassette 30U is returned to the initial vertical state by the pendulum system 41U and moved to the transmission side of the printing press 11 by the shifting mechanism 42U.

[AUTOMATIC MACHINE-PLATE CHANGE FOR LOWER PLATE CYLINDER 13L BY AUTOMATIC LOWER MACHINE-PLATE CHANGE DEVICE 20L]

As for the automatic lower machine-plate change device 20L, the new-plate cassette 30L is moved by the shifting mechanism 42L and the pendulum system 41L to be in the state illustrated with a solid line in FIG. 5, and then the automatic machine-plate change is facilitated in almost the same steps as the automatic upper machine-plate change device 20U.

The followings are different points from the automatic upper machine-plate change device 20U.

First, the position, which is an interface of touching and non-touching states between the machine-plate and the plate cylinder 13U (the position where the machine-plate is peeled from the plate cylinder 13U), is the upper position of the plate cylinder 13U, therefore, the machine-plate is pressed on to the plate cylinder 13U by self-weight when the used-plate 90L is peeled and the new-plate 80L is wound, whereby parts corresponding to the rear weight roller 24U of the automatic upper machine-plate change device 20U are not needed.

Like the the automatic upper machine-plate change device 20U, the new-plate 80U is delivered to the plate cylinder 13U by the new-plate delivery air-cylinder device 61L, however, in this case, the new-plate 80L pulled upward by the rotation of the plate cylinder 13L is not loosened by tension effected by self-weight, therefore parts corresponding to the new-plate foot gripper 60 and the tensional reel 62 of the automatic upper machine-plate change device 20U are not provided.

Furthermore, there are two different points from the automatic machine-plate change device 20U; the used-plate head 91L ofthe used-plate 90L, which is hooked on the end of the plate head peeler 52L after being peeled from the plate cylinder 13L by the plate head peeler 52L, is sent upward by the plate head kick-pin 77; and parts corresponding to the belt conveyor 50 for delivering the used-plate 90L are not provided, so that the usedplate 90L is directly delivered to the used-plate receiver 27L without using the belt conveyor 50.

[TIMING OF AUTOMATIC MACHINE-PLATE CHANGE IN PLATE-CYLINDER 13U, 13L OF EACH PRINTING PRESS 11]

Figure 16:
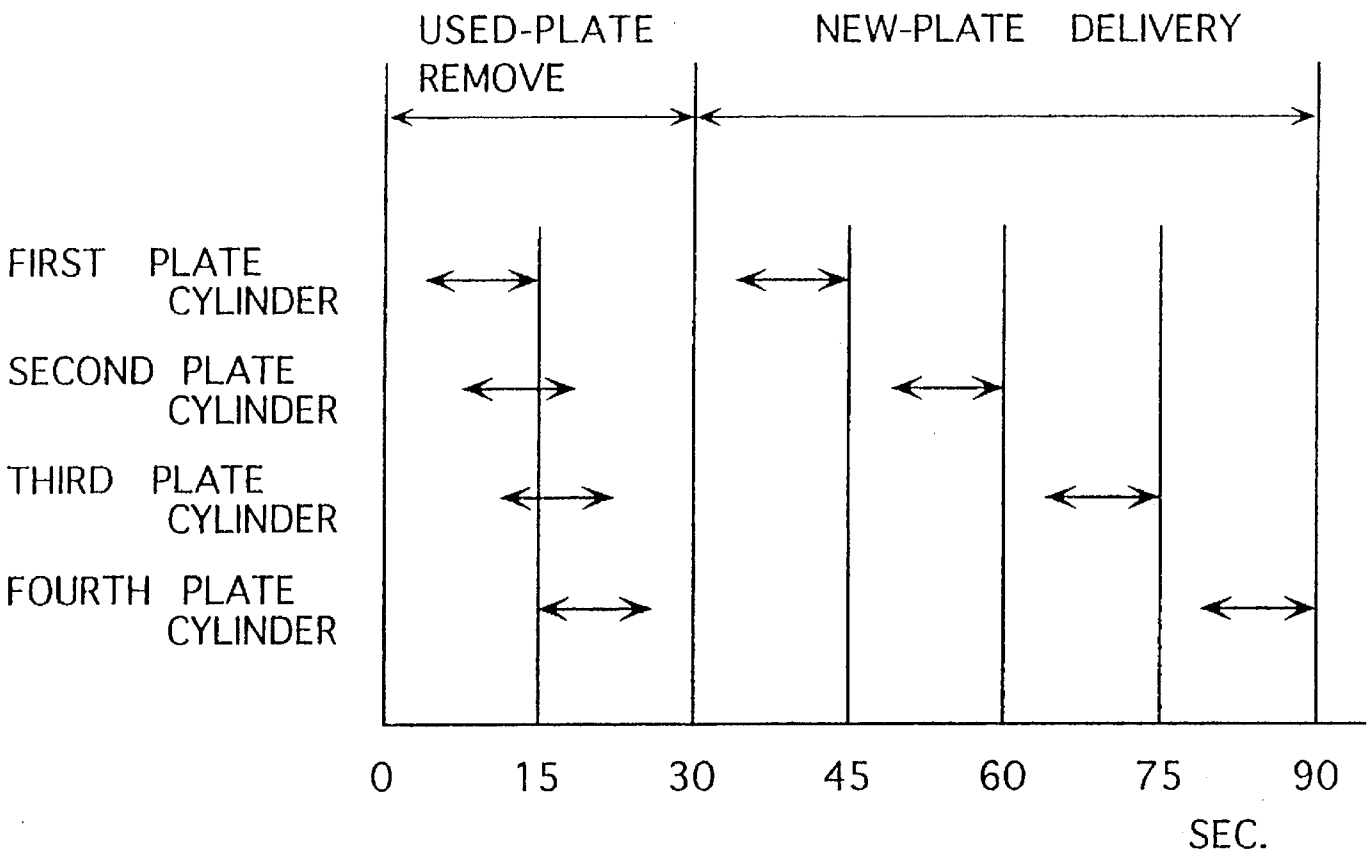
FIG. 16 is an explanatory diagram of the timing of the automatic machine-plate change of the embodiment.

For example, when the web-offset printing press 10 is of a both-side two-color printing machine and has two printing presses 11 (four plate cylinders), the automatic machine-plate change can facilitate under the timing as shown in FIG. 16, but this example is not intended to be particularly limiting. The x-axis (unit: second) of FIG. 16 is an example of the necessary time for the automatic machine-plate change.

The used-plates 90U, 90L can be removed under the condition that the plate cylinders 13U, 13L are not interrupted and rotated in the wrong direction, therefore, the automatic machine-plate change can be simultaneously carried out for all the four plate cylinders. In FIG. 16, the four plate cylinders respectively receive the work of removing the used-plates in different phases, finishing the all the work of removing the used-plates while the plate cylinders 13U, 13L make almost two revolutions.

During winding of the new-plates 80U, 80L, when the catch groove 19A catches the new-plate head 81U of the new-plate 80U, the plate cylinder 13U, 13L are changed from the interrupting state to the gently rotating state at the low speed. However, usually, each phase of the catch groove 19A on the plate cylinder does not accord with one another, so that the automatic machine-plate change for the four plate cylinders takes place in order.

According to the embodiment, there will be the following effects.

That is, the new-plates 80U, 80L are accommodated into the new-plate cassettes 30U, 30L, then, the automatic machine-plate change is facilitated by moving these new-plate cassettes 30U, 30L by means of the movement systems 40U, 40L, so that the new-plates 80U, 80L can be certainly delivered onto the plate cylinders 13U, 13L even in an undesirable surrounding caused by, for example, ink-mist and paper-dust, and further, anxiety caused by the machine-plate being damaged by fall, can be eliminated, with the result that certainty and reliability for the automatic machine-plate change can be sufficiently progressed as compared with the conventional automatic machine-plate change using a robot and a vacuum device.

Comparing with the use of the robot, there is no complex operation and the automatic machine-plate change is actualized with a simple mechanical structure and easy operation, whereby the machine-plates can be changed quickly and efficiently and the cost for facilities can be reduced.

By accompanying with automatization the work of removing the used-plate and the work of winding the new-plate, which is known from the aforementioned Japanese Patent Application Laid-open No. Hei 5-246013 by the present applicant, more efficient automatization for all processes of the automatic machine-plate change can be facilitated.

The movement systems 40U, 40L are structured to respectively have the pendulum systems 41U, 41L and the shifting mechanisms 42U, 42L, whereby simplification of the mechanical structure and operation, and a reduction in the space required for facilities can be easily and certainly facilitated.

The new-plate foot gripper 60 supporting the new-plate 80U and the tensional reel 62 pulling the new-plate foot gripper 60 are provided in the new-plate cassette 30U of the automatic upper machine-plate change device 20, so that looseness of the new-plate 80U is prevented, with the result that the new-plate 80U can be smoothly delivered from the new-plate cassette 30U onto the plate cylinder 13U.

The plate head peelers 52U, 52L are respectively provided on the edges 32U, 32L of the new-plate cassettes 30U, 30L, so that the ends of the plate head peelers 52U, 52L can be projected toward the plate cylinders 13U, 13L in order to hook and easily peel the used-plate heads 91U, 91L of the used-plates 90U, 90L from the plate cylinders 13U, 13L, therefore, the used-plates 90U, 90L can be smoothly removed from the plate cylinders 13U, 13L, and further the used-plates 90U, 90L can be removed while the plate cylinders 13U, 13L are not interrupted but continued rotating, with the result that the time required for changing the machine-plates can be shorter.

By using the belt conveyor 50, the clamp conveyance roller 54, the foot pass detecting sensor 56, and the head pass detecting sensor 57, which are oriented next to the new-plate cassette 30U of the automatic upper machine-plate change device 20U, the clamp conveyance roller 54 can press the used-plate 90U on the belt conveyor 50 to avoid bending portions of the used-plate foot 92U and the used-plate head 91U of the used-plate 90U, therefore, the used-plate 90U can be removed much more harmoniously.

When the new-plate heads 81U, 81L of the new-plate 80U, 80L are to be engaged into the catch grooves 19A, the weight rollers 28U, 28L are moved to the plate cylinders 13U, 13L and also the plate cylinders 13U, 13L are rotated in the low speed, so that the catch grooves 19A can definitely catch the new-plate heads 81U, 81L of the new-plates 80U, 80L, whereas the new-plates 80U, 80L are certainly wound on the plate cylinders.

Since the new-plate cassettes 30U, 30L are capable of accommodating the new-plates 80U, 80L from the edges 31U, 31L as their one lateral sides, the work for accommodating the new-plates into the new-plate cassettes 30U, 30L is easily facilitated, while simplifying the mechanical structure.

All of the used-plates wound around the plate cylinders can be simultaneously removed by the new-plate cassettes 30U, 30L oriented in response to each of the plate cylinders 13U, 13L of each printing press 11, whereby the necessary time for changing the machine-plates can be shorter and shorter. It is especially useful when used for a both-side four-color printing machine (a machine having eight plate cylinders).

The new-plate cassettes 30U, 30L are oriented in response to each of the plate cylinders 13U, 13L of each printing press 11, therefore, the operation of the new-plate cassettes 30U, 30L becomes easier, whereby the necessary time for changing the machine-plates can be shorter and shorter.

Furthermore, the new-plate cassettes 30U, 30L including the side press roller 70 cause the new-plates 80U, 80L accommodated into the new-plate cassettes 30U, 30L to certainly arrange in to predetermined positions (positions to the axis direction of the plate cylinders 13U, 13L), therefore, the new-plates 80U, 80L can be certainly wound onto predetermined positions (positions of the axis direction) on the plate cylinder 13U, 13L.

In the automatic upper machine-plate change device 20U and the automatic lower machine-plate change device 20L, the eccentric shafts 66 and the clamps 68 are respectively provided, thereby the side phases (positions to the axis direction of the plate cylinder 13U, 13L) of the new-plates 80U, 80L can be adjusted by causing the eccentric shafts 66 to rotate, and also the new-plates 80U, 80L can be certainly delivered in the side phases by the clamps 68 fixing to the eccentric shafts 66.

During the operation of the automatic machine-plate change, furnishing of the protector 29 prevents, for example, an operator from accessing the side of the plate cylinders 13U, 13L through the position of the protector 29.

Furnishing of the stoppers 25U, 25L cause the turning of the new-plate cassettes 30U, 30L by the pendulum systems 41U, 41L to be able to certainly stop at the required position, whereby the new-plates 80U, 80L can be smoothly delivered to the plate cylinders 13U, 13L.

Incidentally, it is to be understood that the present invention is not intended to be limited to the aforementioned embodiment, and modifications and so on may be made therein without departing from the spirit of the present invention.

That is, the shifting mechanisms 42U, 42L are structured to automatically shift the new-plate cassettes 30U, 30L by the shift driving means 45U, 45L in the aforementioned embodiment, however, it may be structured that the operator shifts the new-plate cassettes 30U, 30L by hand.

The pendulum systems 41U, 41L are structured to automatically turn the new-plate cassettes 30U, 30L by the air cylinder devices 48U, 48L as the pendulum driving means, however, it may be structured that the operator turns the new-plate cassettes 30U, 30L by hand.

Furthermore, in the aforementioned embodiment, the operator puts the new-plates 80U, 80L into the new-plate cassettes 30U, 30L by hand, however, a automatic new-plate accommodation means may be provided to automatically accommodate the new-plates 80U, 80L into the new-plate cassettes 30U, 30L.

In the aforementioned embodiment, the automatic machine-plate change system according to the present invention is used for the rotation printing press for a both-side print, however, the present invention may be used for the rotation printing press for a single-side print or for the rotation printing press for a monochrome print without limiting its use to the rotation printing press for a multicolor print.

According to the present invention as described thus far, the automatic machine-plate change is facilitated by moving the new-plate cassette accommodating the new-plate by the movement system, so that the simple mechanical structure and simple operation effect the actualization of the automatic machine-plate change, whereby the machine-plates can be quickly and efficiently changed, cost for facilities is reduced, and there is an effect which certainty and reliability can be progressed.

If the detachable weight roller, which is provided to rotatably touch to the circumferential surface of the plate cylinder, is moved toward the plate cylinder and the plate cylinder is rotated at the low speed when the new-plate head of the new-plate is inserted to the catch groove provided on the circumferential surface of the plate cylinder, the new-plate head of the new-plate can be certainly inserted into the catch groove, resulting in an effect in which the new-plate is certainly wound.

If the movement system is structured to have the pendulum system and the shifting mechanism, there is an effect which simplification of the mechanical structure and operation, and a reduction in the required space for facilities can be much easily and certainly facilitated.

And, looseness of the new-plate can be prevented by providing the new-plate foot gripper supporting the new-plate and the tensional reel pulling the new-plate foot gripper in the new-plate cassette, therefore, delivery of the new-plate from the new-plate cassette to the plate cylinder is smoothly performed, and it is very effective especially when the new-plate is delivered to the plate cylinder in a downward direction.

If the plate head peeler, which is capable of moving to and away from the plate cylinder to peel the used-plate head of the used-plate from the plate cylinder, is provided on the edge of the new-plate cassette at the side of the plate cylinder, the end of the plate head peeler is projected toward the plate cylinder in order to hook the used-plate head of the used-plate and then can easily peel the used-plate from the plate cylinder, therefore, delivery of the used-plate can be smoothly facilitated, and further, the used-plate is delivered while the plate cylinder continue rotating without interrupting its rotation, resulting in a reduction of time necessary for the changing of the plates.

Furthermore, when the belt conveyor is used for delivering the used-plate, the clamp conveyance roller, the foot pass detecting sensor and the head pass detecting sensor are oriented next to the new-plate cassette, the used-plate can be pressed on the belt conveyor by the clamp conveyance roller to avoid the bending of the head and foot of the used-plate, resulting in a much smoother delivery of the used-plate.

What is claimed is:

1. A method for an automatic machine-plate change in a rotation printing press, the improvement comprising the steps of:

accommodating a new-plate for winding around a plate cylinder into a new-plate cassette provided in a printing press having the plate cylinder;

delivering the new-plate to a position next to the plate cylinder by moving the new-plate cassette to cause the edge of the new-plate cassette to approach the plate cylinder;

removing a used-plate previously wound around the plate cylinder by rotating the plate cylinder in an unwinding direction after delivering the new-plate into a position next to the plate cylinder in the new-plate cassette and driving a belt conveyor fixed to the new-plate cassette;

winding the new-plate around the plate cylinder after the new-plate, accommodated into the new-plate cassette, is moved toward the plate cylinder; and moving the new-plate cassette to cause the edge of the new-plate cassette to move away from the plate cylinder.

2. The method for the automatic machine-plate change in the rotation printing press according to claim 1, wherein the step of removing the used-plate includes the steps of preparing a detachable clamp conveyance roller for pressing the used-plate onto the belt conveyor by detecting the passing of a used-plate foot of the used-plate in a downstream direction from a provided position of the clamp conveyance roller in a delivering direction with a foot pass detecting sensor and by detecting the passing of a used-plate head of the used-plate in an upstream direction from a provided position of the clamp conveyance roller in the delivering direction with a head pass detecting sensor, peeling the used-plate from the plate cylinder bit by bit while the plate cylinder is being rotated in an unwinding direction while driving the belt conveyor, detecting the passing of the usedplate foot of the used-plate by the foot pass detecting sensor to ascertain that the used-plate foot passes through the position of the clamp conveyance roller, pressing the used-plate onto the belt conveyor after the clamp conveyance roller is in an attaching state, and dislocating the clamp conveyance roller into a detaching state just before the used-plate head passes through the position of the clamp conveyance roller after the head pass detecting sensor detects passing the used-plate head of the used-plate.

3. The method for the automatic machine-plate change in the rotation printing press according to claim 1, wherein the step of delivering the new-plate to the plate cylinder with the new-plate cassette includes inserting the new-plate into the new-plate cassette effected to be in a vertical state, and then causing the edge to approach the plate cylinder by pivoting the new-plate cassette at a fulcrum near the other edge opposite to the edge.

4. The method for the automatic machine-plate change in the rotation printing press according to claim 1, wherein the step of winding the new-plate sent toward the plate cylinder from the new-plate cassette accommodating the new-plate includes the steps of engaging a new-plate head of the new-plate into a catch groove provided on the circumferential surface of the plate cylinder while moving detachable weight rollers provided to rotatably touch the circumferential surface of the plate cylinder toward the plate cylinder and rotating the plate cylinder at low speed.

5. The method for the automatic machine-plate change in the rotation printing press according to claim 1, wherein the step of winding the new-plate sent toward the plate cylinder from the new-plate cassette accommodating the new-plate includes the step of pulling a new-plate foot gripper abutted to a new-plate foot of the new-plate to support the new-plate in the opposite direction of the plate cylinder by a tensional reel.

6. An automatic machine-plate change device in a rotation printing press, comprising:

a new-plate cassette provided in a printing press having a plate cylinder, the new-plate cassette accommodating a new-plate to be wound around the plate cylinder; and a movement system moving the new-plate cassette thereby causing an edge of the new-plate cassette to move toward and away from the plate cylinder, the movement system having a pendulum system causing the edge to move toward and away from the plate cylinder by pivoting the new-plate cassette at a fulcrum near the other edge opposite to the edge, and having a shifting mechanism causing the new-plate cassette to shift along a direction with an aligned axis of the plate cylinder.

7. The automatic machine-plate change device in the rotation printing press according to claim 6, wherein the shifting mechanism has a guide rail oriented horizontally, a carriage rotatably supporting the other edge of the new-plate cassette and slidably guided by the guide rail and a shift driving means moving the carriage; and wherein the pendulum system has a pendulum shaft rotatably connecting the carriage and the new-plate cassette, and a pendulum driving means for turning the new-plate cassette on the pendulum shaft.

8. The automatic machine-plate change device in the rotation printing press according to claim 7, wherein the shifting mechanism has an eccentric shaft means oriented on the guide rail in a direction intersecting a lengthwise direction of the guide rail for determining a stop position of the shifting carriage by abutting a side of the carriage, and by rotating the eccentric shaft means, the stop position of the carriage being adjusted in a shifting direction and a side phase of the new-plate accommodated in the new-plate cassette being adjusted.

9. The automatic machine-plate change device in the rotation printing press according to claim 8, wherein a clamp means having a handle for rotating the clamp means at the end of the clamp means, the clamp means being fixed on a side of the carriage for clamping the eccentric shaft to the side of the carriage by rotating the handle.

10. The automatic machine-plate change device in the rotation printing press according to claim 6, wherein the pendulum system has a stopper abutting the new-plate cassette to stop the new-plate cassette from making a turn caused by the pendulum system, and has an adjusting nut for adjusting a stop position, which is provided on the abutting face of the stopper.

11. An automatic machine-plate change device in a rotation printing press, comprising:

a new-plate cassette provided in a printing press having a plate cylinder, the new-plate accommodating a new-plate to be wound around the plate cylinder;

a movement system for moving the new-plate cassette thereby causing an edge of the new-plate cassette to move toward and away from the plate cylinder; and the new-plate cassette having a new-plate foot gripper supporting the new-plate by abutting the new-plate foot of the new-plate, and a tensional reel pulling the new-plate foot gripper in a direction opposing the plate cylinder.

12. The automatic machine-plate change device in the rotation printing press according to claim 11, wherein the new-plate cassette has a new-plate delivery air-cylinder device moving the new-plate foot gripper along the new-plate cassette to send off the new-plate toward the plate cylinder.

13. The automatic machine-plate change device in the rotation printing press according to claim 11, wherein the new-plate foot gripper has a gripper body slidably guided by a guide bar arranged along the new-plate cassette, a grip portion rotatably oriented to the gripper body and having a hook at the end of the grip portion to hook the new-plate foot of the new-plate, and a cam follower rotatably oriented to the grip portion.

14. The automatic machine-plate change device in the rotation printing press according to claim 13, wherein the new-plate cassette fixedly has a grip release cam abutting the cam follower of the new-plate foot gripper, the end of the grip portion of the new-plate foot gripper being adapted to release the new-plate foot of the new-plate by abutting the cam follower to the grip release cam after the new-plate foot gripper is moved to the grip release cam.

15. The automatic machine-plate change device in the rotation printing press according to claim 6, wherein an edge of the new-plate cassette has thereon a plate head peeler means for peeling a used-plate head of a used-plate wound around the plate cylinder from the plate cylinder, the plate head peeler means peeling the used-plate head of the used-plate from the plate cylinder by projecting an end of the plate head peeler toward the plate cylinder.

16. The automatic machine-plate change device in the rotation printing press according to claim 6, further comprising, a belt conveyor means fixed to the new-plate cassette to be moved with the new-plate cassette by the movement system for removing a used-plate from the plate cylinder, a detachable clamp conveyance roller means fixed between the new-plate cassette and the belt conveyor means for pressing the used-plate on the belt conveyor means, a foot pass detecting sensor fixed near the belt conveyor means detecting the passing of the used-plate foot of the used-plate through a downstream delivering direction from the clamp conveyance roller means, and a head pass detecting sensor fixed near the belt conveyor means detecting the passing of a used-plate head of the used-plate through an upstream delivering direction from the clamp conveyance roller means.

* * * * *